US006076606A

United States Patent [19]

Bailey et al.

[11] Patent Number: 6,076,606

[45] Date of Patent: Jun. 20, 2000

[54] THROUGH-TUBING RETRIEVABLE WHIPSTOCK SYSTEM

[75] Inventors: Thomas F. Bailey; Timothy L. Wilson; Dustin G. Howell, all of Houston, Tex.

[73] Assignee: Weatherford/Lamb, Inc.

[21] Appl. No.: 09/150,962

[22] Filed: Sep. 10, 1998

[51] Int. Cl.[7] ..... E21B 7/08

[52] U.S. Cl. ..... 166/382; 166/117.6

[58] Field of Search ..... 166/298, 35.7, 166/117.6, 117.5, 380, 382

[56] References Cited

U.S. PATENT DOCUMENTS

| | | | |
|---|---|---|---|
| 3,115,935 | 12/1963 | Hooton | 166/117.6 |
| 3,993,128 | 11/1976 | Braddick | 166/216 |
| 3,999,605 | 12/1976 | Braddick | 166/212 |
| 4,397,355 | 8/1983 | McLamore | 166/117.6 |
| 4,688,642 | 8/1987 | Baker | 166/382 |
| 4,765,404 | 8/1988 | Bailey et al. | 166/117.6 |
| 4,942,924 | 7/1990 | Duncan | 166/290 |
| 5,012,877 | 5/1991 | Winters et al. | 175/80 |
| 5,115,872 | 5/1992 | Brunet et al. | 175/61 |
| 5,154,231 | 10/1992 | Bailey et al. | 166/298 |
| 5,168,942 | 12/1992 | Wydrinski | 175/50 |
| 5,193,620 | 3/1993 | Braddick | 166/382 |
| 5,222,554 | 6/1993 | Blount et al. | 166/117.6 |
| 5,346,017 | 9/1994 | Blount et al. | 166/380 |
| 5,383,522 | 1/1995 | Hailey | 166/382 |
| 5,452,759 | 9/1995 | Carter et al. | 166/117.6 |
| 5,467,819 | 11/1995 | Braddick | 166/117.6 |
| 5,522,461 | 6/1996 | Carter et al. | 166/298 |
| 5,531,271 | 7/1996 | Carter | 166/117.6 |
| 5,535,822 | 7/1996 | Schock et al. | 166/50 |
| 5,595,247 | 1/1997 | Braddick | 166/297 |
| 5,620,051 | 4/1997 | Carter et al. | 166/298 |
| 5,678,634 | 10/1997 | Rehbock et al. | 166/377 |
| 5,697,438 | 12/1997 | Rehbock et al. | 166/55.7 |
| 5,725,060 | 3/1998 | Blount et al. | 175/61 |
| 5,743,331 | 4/1998 | Adkins et al. | 166/55.7 |
| 5,762,143 | 6/1998 | Comeau et al. | 166/381 |
| 5,787,978 | 8/1998 | Carter et al. | 166/117.65 |
| 5,794,694 | 8/1998 | Smith, Jr. | 166/212 |
| 5,806,596 | 9/1998 | Hardy et al. | 166/298 |
| 5,829,531 | 11/1998 | Hebert et al. | 166/382 |
| 5,832,997 | 11/1998 | White et al. | 166/117.6 |
| 5,947,201 | 9/1999 | Ross et al. | 166/117.6 |

*Primary Examiner*—William Neuder
*Attorney, Agent, or Firm*—Guy McClung

[57] ABSTRACT

The present invention, in certain embodiments, discloses a whipstock system which is hydraulically settable in a tubular or wellbore and mechanically retrievable. In one aspect it is a "through-tubing" system. In certain aspects systems according to this invention have a concave to a lower end of which is secured an anchor housing bendable member, movable connection, or with an anchor body therein that is in fluid communication, via a flexible hose within the anchor housing, with a fluid channel running through the concave. An upper end of a mandrel is housed in a recess in the anchor body. The mandrel's lower end may extend out from the anchor housing. A setting slip is disposed below the anchor body within an opening in the anchor housing. A pusher sleeve below the slip is selectively displaced up by a piston below the pusher sleeve to push the slip out from the opening in the anchor housing to set against an interior of a tubular or of a wellbore. Fluid under pressure flows, e.g. from a pump system at the earth's surface, through the concave, through the anchor body, to and through the mandrel, exiting the mandrel beneath the piston to move the piston upwardly, thereby moving the slip out from the housing. Initially a shear pin or shear screw holds the slip in place.

The present invention also discloses a retrieval tool for retrieving the whipstock system from a wellbore. The retrieval tool, in one aspect, has a member that is inserted into and held within a corresponding recess in the top of a concave while an opposed portion of the tool abuts a side of the concave opposite the recess to securely grip the concave and the apparatus suspended therefrom for retrieval.

24 Claims, 24 Drawing Sheets

T
12
11
15
10
14
13
15
22
21
20
23
24
50
40
31
30
43
61
32
60
40
64
80
84
70
74
94
90
15
41

46
45
40
40
43

40b
40a

FIG. 4C
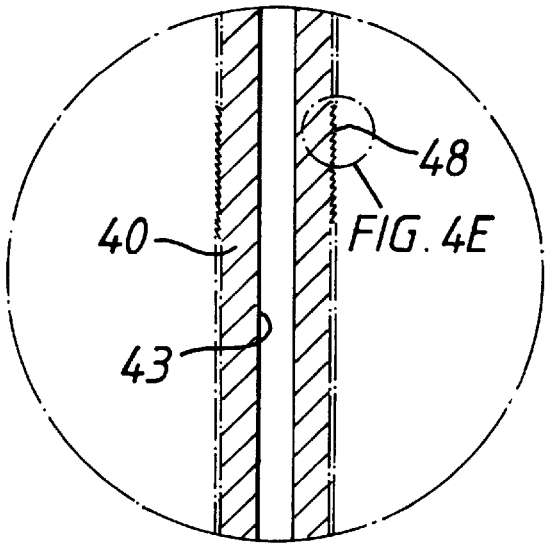
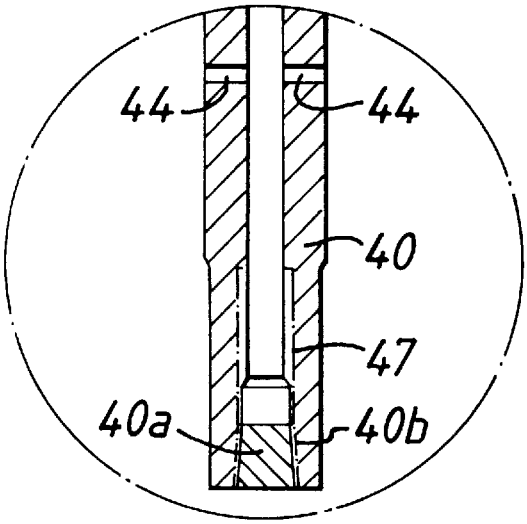
FIG. 4D
FIG. 4E
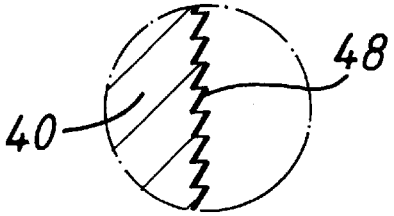

THROUGH-TUBING RETRIEVABLE WHIPSTOCK SYSTEM

BACKGROUND OF THE INVENTION

1. Field of the Invention

The present invention is related to: whipstocks and associated apparatus for use in wellbores; whipstocks insertable through one tubular into another, e.g., but not limited to, through a smaller diameter tubing into a larger diameter casing; whipstock retrieval; anchoring apparatus for use in tubulars; and methods of use of such tools and apparatuses.

2. Description of Related Art

A variety of whipstocks and related milling systems are available in the prior art; e.g., but not limited to, the devices disclosed in U.S. Pat. Nos. 5,595,247; 5,772,972; 5,455,222; 5,452,759; 5,222,554; 5,211,715; 5,195,591; 5,109,924; 4,491,178; and 4,266,621.

Whipstocks and whipstock systems are tools inserted in a wellbore for deflecting a drill bit, mill, mill-drill, or other tool in a direction that is angularly offset with respect to the orientation wellbore. The deflected tool establishes a new or additional drilling path. In many instances, a whipstock set in a casing string on an anchor provides an angled whipstock surface or whipstock face at a desired depth in a wellbore to conduct side track or lateral directional drilling operations through a casing string. The face of the whipstock is oriented to position a casing window at a desired radial azimuth relative to the axis of the casing to provide a new drilling course.

Often a window is formed in a casing string that includes a smaller diameter tubing string that terminates at a position above a desired position of the casing window. Since the removal of the tubing string requires considerable rig time and expense, "through-tubing" whipstock systems have been developed for first passing through the tubing string then setting in a casing string at the desired depth for milling or cutting the window in the casing string. Once the window has been properly cut in the casing string, a side track or lateral drilling operation proceeds in a desired azimuthal direction relative to the casing string. Often a drill motor, and a bit rotatable by the drill motor, are suspended from a coiled tubing workstring for engaging a set whipstock in a casing string. Fluid is pumped through the coiled tubing workstring to drive the drill motor, so that the rotating bit engages the whipstock face and begins cutting a window in the casing string with an operation involving a single run-in trip of coiled tubing workstring.

There is a need for an effective whipstock and associated apparatus which is insertable through a smaller diameter tubular, such as tubing, and then disposable in a larger diameter tubular, such as casing, below the smaller diameter tubular. There is a need for such devices which effectively anchor and correctly orient themselves in the larger diameter tubular, and which are, in certain aspects, easily retrieved.

SUMMARY OF THE PRESENT INVENTION

The present invention, in certain embodiments, discloses a through-tubing whipstock system which, in one aspect, is retrievable and which is insertable in a wellbore through a smaller diameter tubular (e.g. casing or tubing) into a tubular of larger diameter (e.g. casing or tubing). In one aspect, such a system includes a concave to a lower end of which is secured an anchor housing that is in fluid communication, via a flexible hose, with an anchor body therein. A fluid channel runs through the concave. An upper end of a mandrel is housed in a recess in the anchor body. The mandrel's lower end, in one aspect, extends out from the anchor housing. A setting slip is disposed below the anchor body within an opening in the anchor housing. A pusher sleeve below the slip is selectively displaced upwardly by a piston below the pusher sleeve to push the slip out from the opening in the anchor housing to set against an interior of a tubular or of a wellbore. Fluid under pressure flows from the surface, through the work string, through the concave, through the anchor body, to and through the mandrel, exiting the mandrel beneath the piston to move the piston upwardly. Initially, a shearable member, e.g. but not limited to a shear pin or pins, holds the slip in place. One or more slips or grip members may be used on the housing opposite the movable slip.

The present invention discloses a retrieval tool for retrieving the whipstock system from a wellbore. The retrieval tool, in one aspect, has a member that is inserted into and held within a corresponding recess in the top of a concave while an opposed portion of the tool abuts a side of the concave opposite the recess to securely grip the concave (and thus the apparatus suspended from the whipstock) for retrieval.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

New, useful, unique, efficient, non-obvious whipstocks, methods for installing them through and in wellbore tubulars, and methods of their use;

Such devices for insertion through a smaller diameter tubular into a larger diameter tubular; in one aspect, for insertion through tubing into casing extending below the tubing;

Such devices which are settable at any desired location in a wellbore or tubular;

Such devices which are retrievable;

New parts for such devices;

Such devices for effective anchoring of a whipstock in a tubular; and

Methods of the use of such devices.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention should be read to include any legally equivalent devices or methods which do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 4A is an enlarged side cross-sectional view of a mandrel of the system of FIG. 1. FIGS. 4B–4E are enlarged views of part of the mandrel of FIG. 4A.

DESCRIPTION OF EMBODIMENTS PREFERRED AT THE TIME OF FILING FOR THIS PATENT

Figure 1:
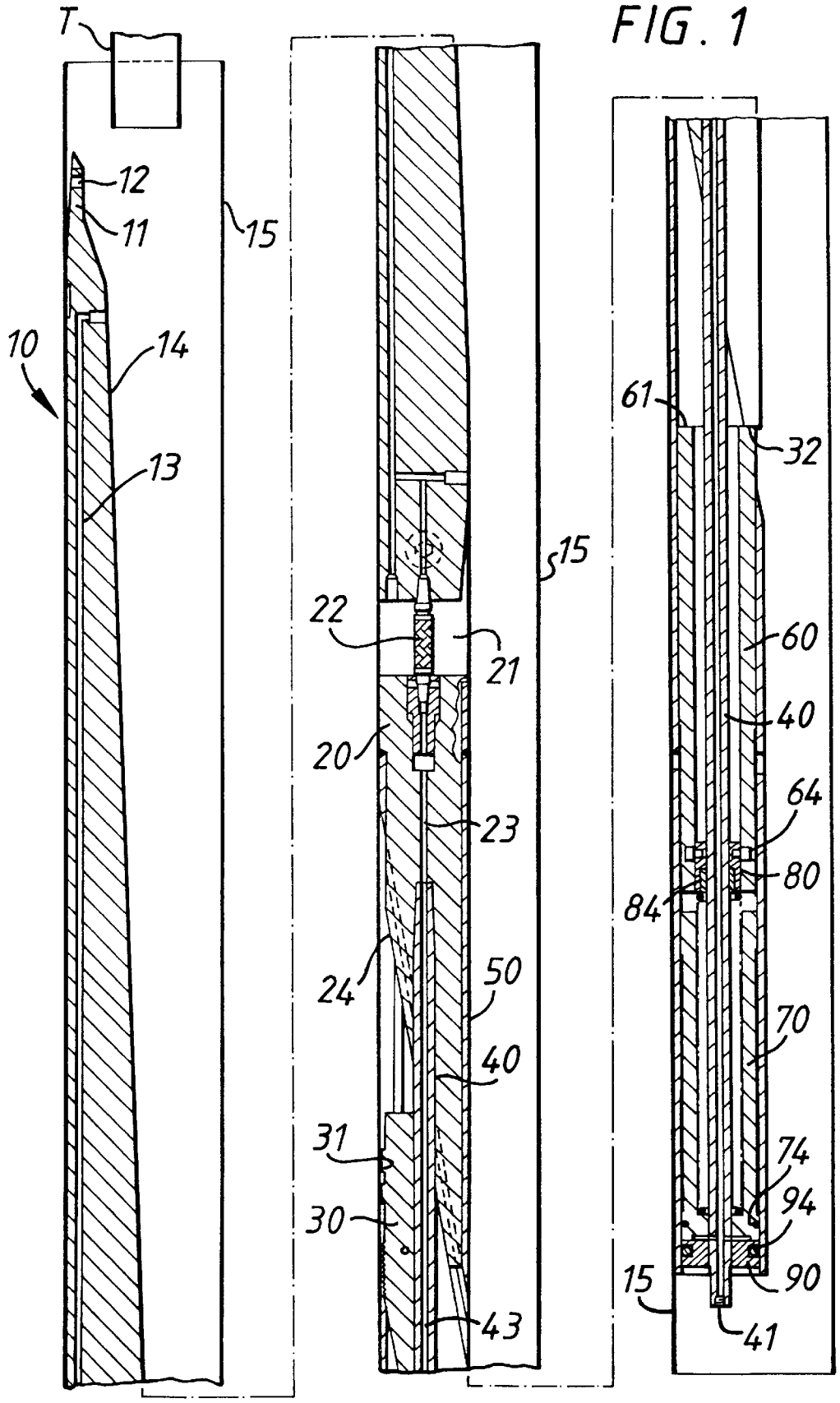
FIG. 1 is a side cross-sectional view of a whipstock system according to the present invention.
Figure 2A:
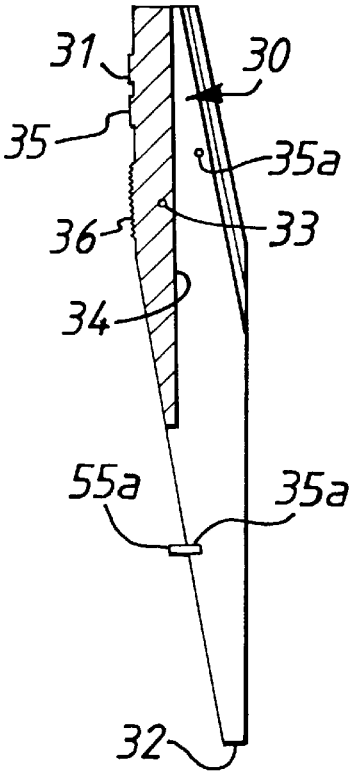
FIGS. 2A–2I are enlarged views of parts of the system of FIG. 1.
Figure 2B:
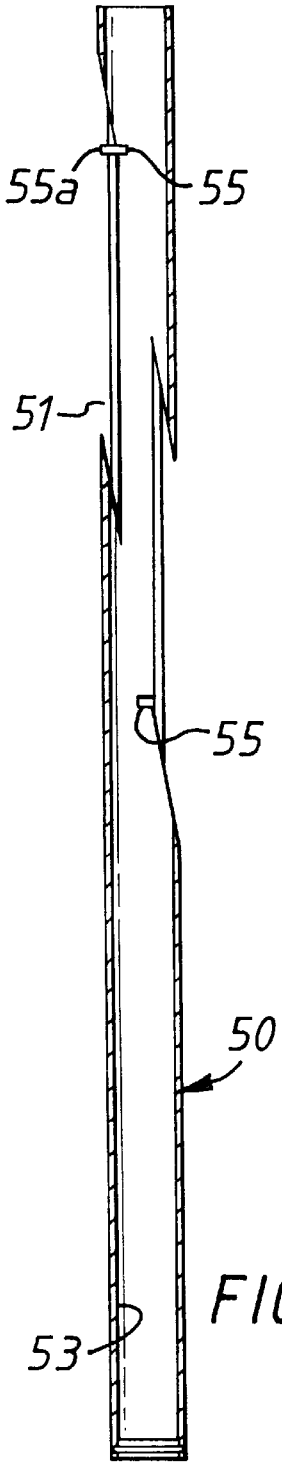
Figure 2C:
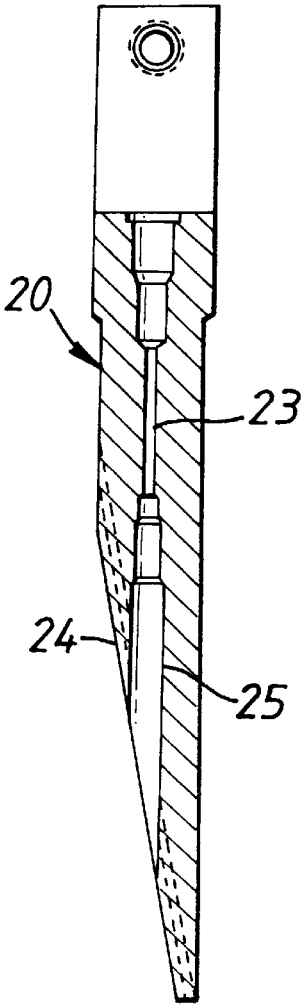
Figure 2I:
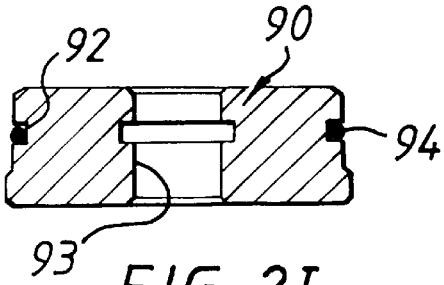
Figure 2D:
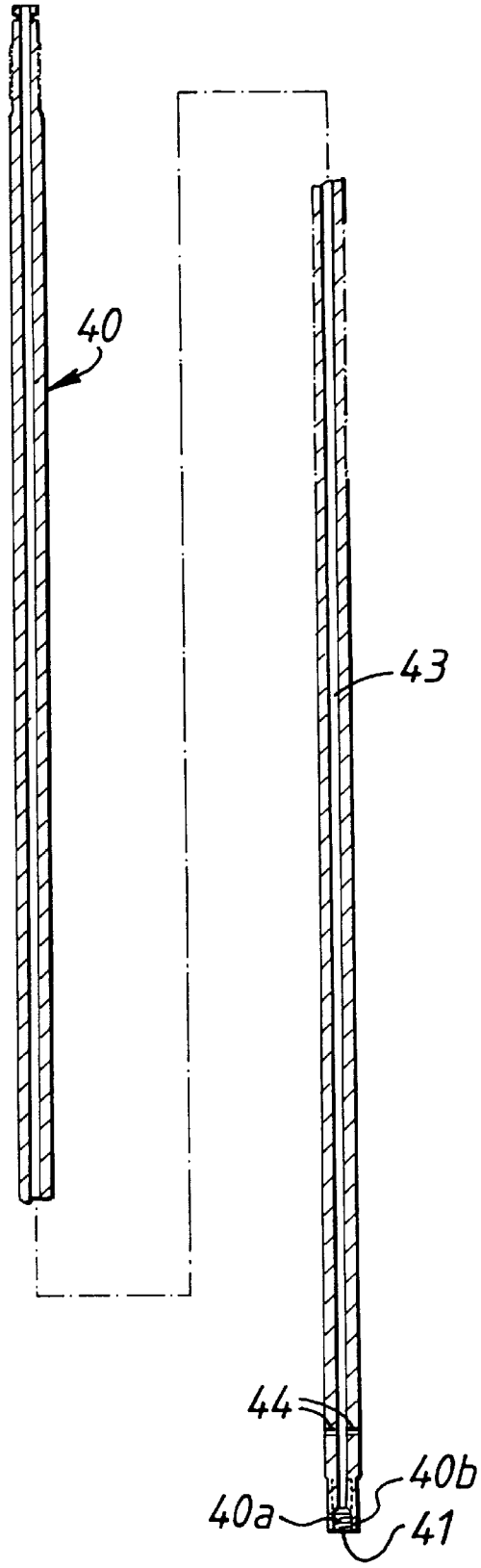
Figure 2E:
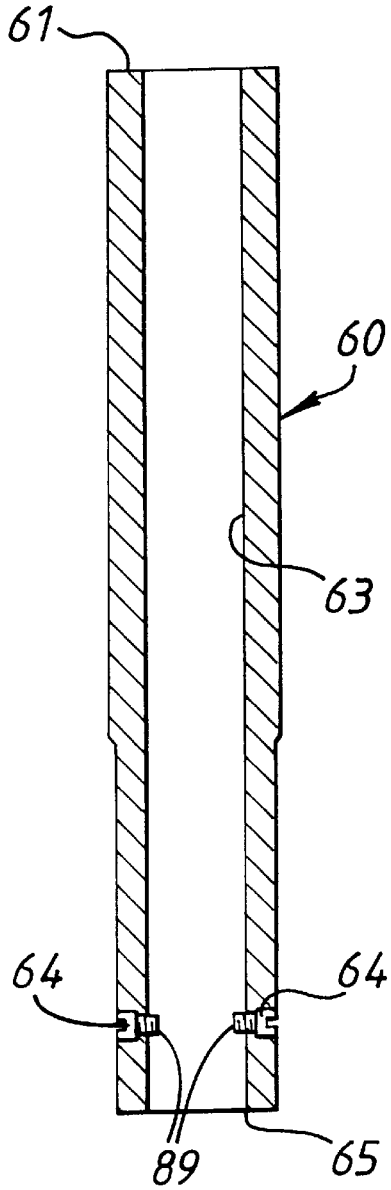
Figure 2F:
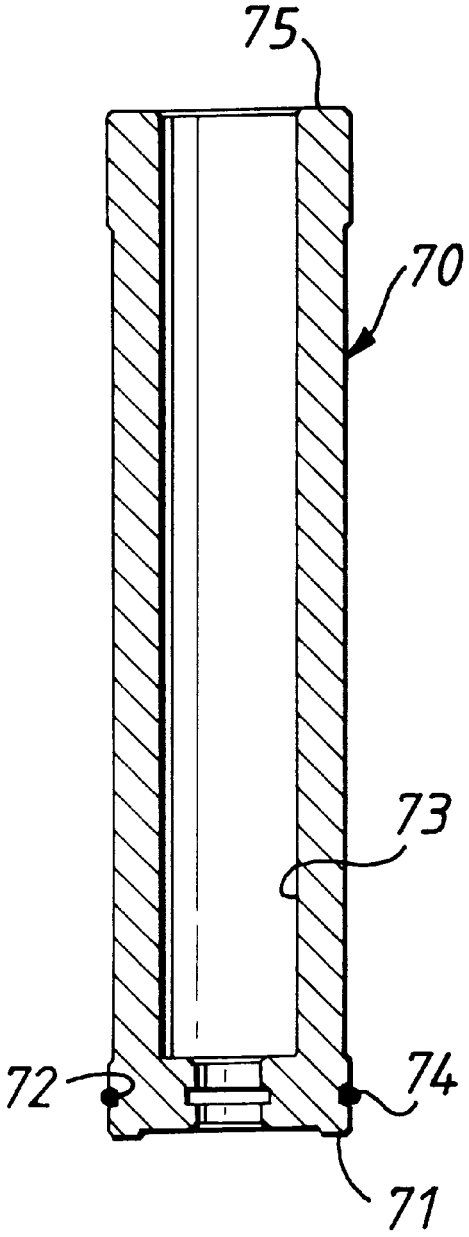
Figure 2G:
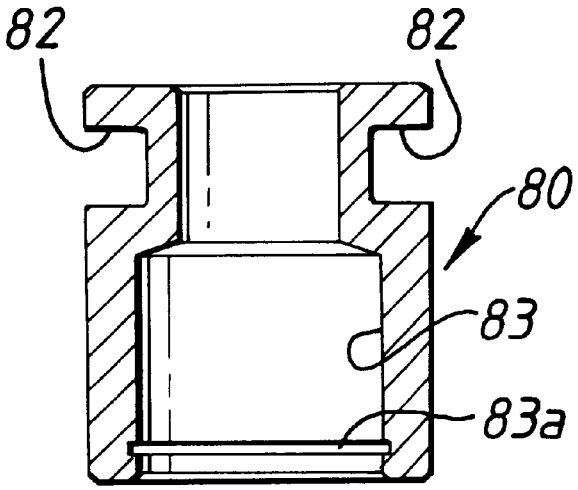
Figure 2H:
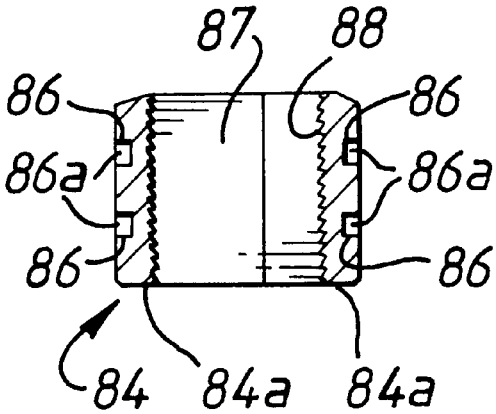

Referring now to FIGS. 1–2F, a system 10 according to the present invention has a concave 14 with an upper end 11 having a hole 12 therethrough for receiving a shear stud, connector, or shear pin for releasably connecting a starter mill, milling assembly, or milling system to the concave 14. A fluid flow channel 13 through the concave 14 provides a flow path for fluid under pressure used to activate anchoring apparatus described below.

The concave 14 is secured e.g. by bolts to an anchor body 20 that has an upper space 21 through which extends bendable tubular or, in one aspect, a flexible hose 22 that provides fluid communication between the concave's fluid flow channel 13 and a fluid flow channel 23 of the anchor body 20. A slanted surface 24 of the anchor body 20 provides a surface against which a slip 30 (described below) is movable to anchor the whipstock system 10 in a casing 15 in a casing string placed below a tubing string T. A lower enlarged portion 25 of the fluid flow channel 23 receives an upper end of a mandrel 40 (described below).

The slip 30 is movably disposed in an opening 51 of an anchor housing 50. The anchor housing 50 has a bore 53 therethrough. The anchor body 20 is disposed within the top of the anchor housing 50 and they are welded together. A space 21 is a space in the anchor body 20. The slip 30 may have any known and suitable outer gripping member or surface 31, marking or non-marking and/or toothed, for engaging an interior surface of the casing 15. In one aspect the surface 31 has toothed surfaces 35 (which resist axial displacement) and 36 (which resist torsion). A lower end 32 of the slip 30 provides a surface for contact by an upper end 61 of a pusher sleeve 60 (described below). The mandrel 40 extends through a slot 34 in the slip 30, down through a channel 63 of the pusher sleeve 60, and through a channel 73 of a piston 70. The mandrel's lower end is blocked off e.g. with a blocking member **40*a* threadedly engaged in a lower threaded bore 40*b***, or with a plug.

The pusher sleeve 60 has screw holes 62 for receiving screws 64 whose inner ends project into screw recesses 82 of a ratchet body 80 to secure the ratchet body 80 to the lower end of the pusher sleeve 60. A channel 83 extends through the ratchet body 80 and the mandrel 40 passes through the channel 83. A latch 84 is held within the ratchet body 80 (e.g. with a snap retaining ring in a groove **83*a* that is disposed below and abutting a lower end of the latch 84). Pins 89 in pin recesses 82 releasably hold the ratchet body 80 and the latch 84 to the pusher sleeve 60. A channel 87 extends through the latch 84. Ratchet teeth 88 are provided on an inner surface of the channel 87 which are sized and disposed to ratchetingly engage corresponding teeth on the part of the mandrel 40 (described below). In one aspect the latch 84 includes a plurality of partial circular segments 84*a* held together by garter springs 86*a* or other suitable connectors residing in recesses 86. The segments 84*a*** can be semicircular, a quarter of a circle or any desired segment size.

The piston 70 has a lower body 71 with an O-ring seal recess 72 for an O-ring seal 74 that seals the interface between an interior surface of the anchor housing 50 and an exterior surface of the piston 70. A top end 75 of the piston 70 is disposed to selectively contact a bottom end 64 of the pusher sleeve 60.

An end cap 90 is removably positioned in a lower end 51 of the anchor housing 50 and seals off the lower end of the anchor housing 50. A lower end 41 of the mandrel 40 passes through a channel 93 through the end cap 90. An O-ring 94 in an O-ring recess 92 seals the anchor housing/end cap interface.

Figure 3A:
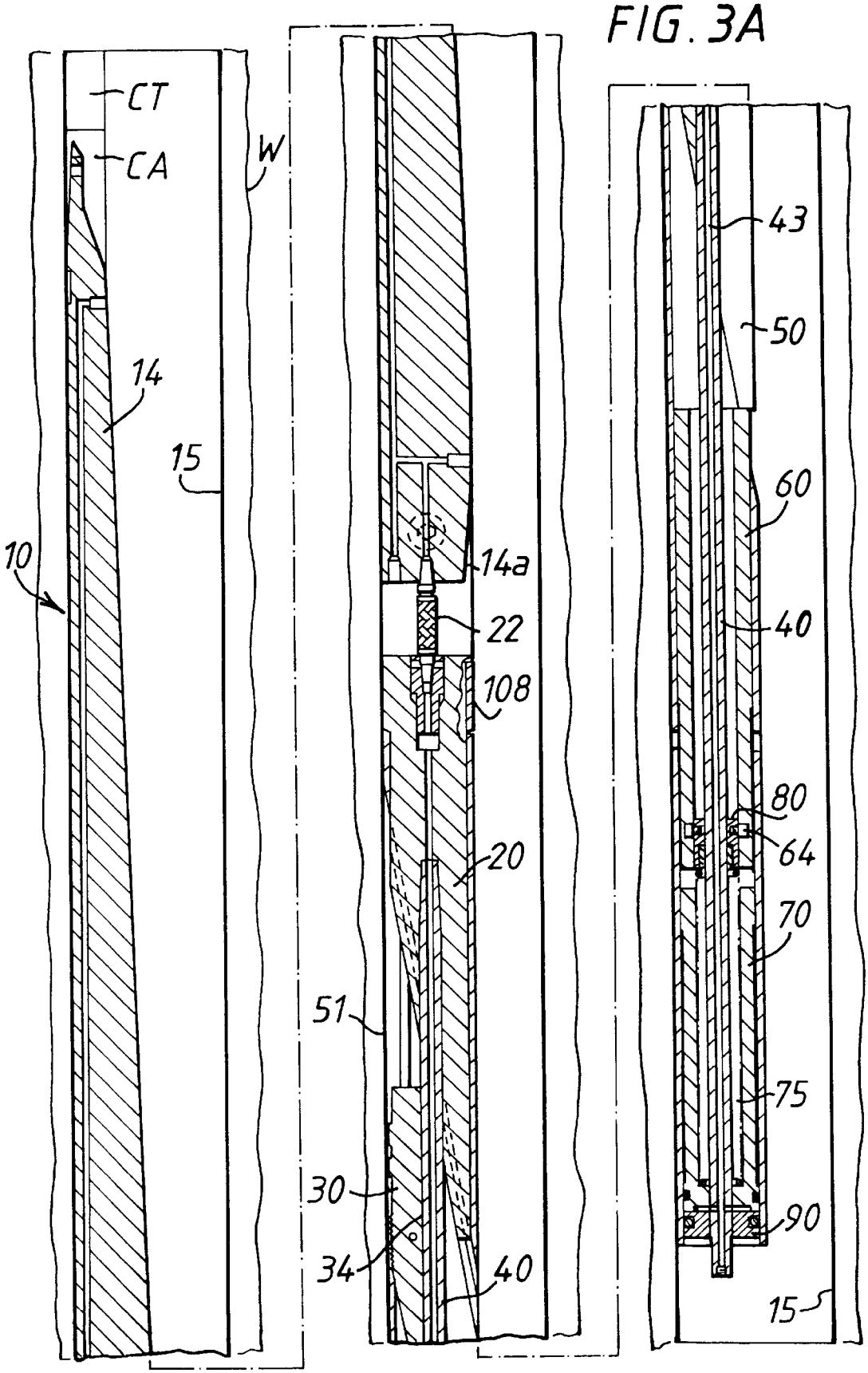
FIGS. 3A–3G are side cross-sectional views showing steps in the operation of the system of FIG. 1.
Figure 3B:
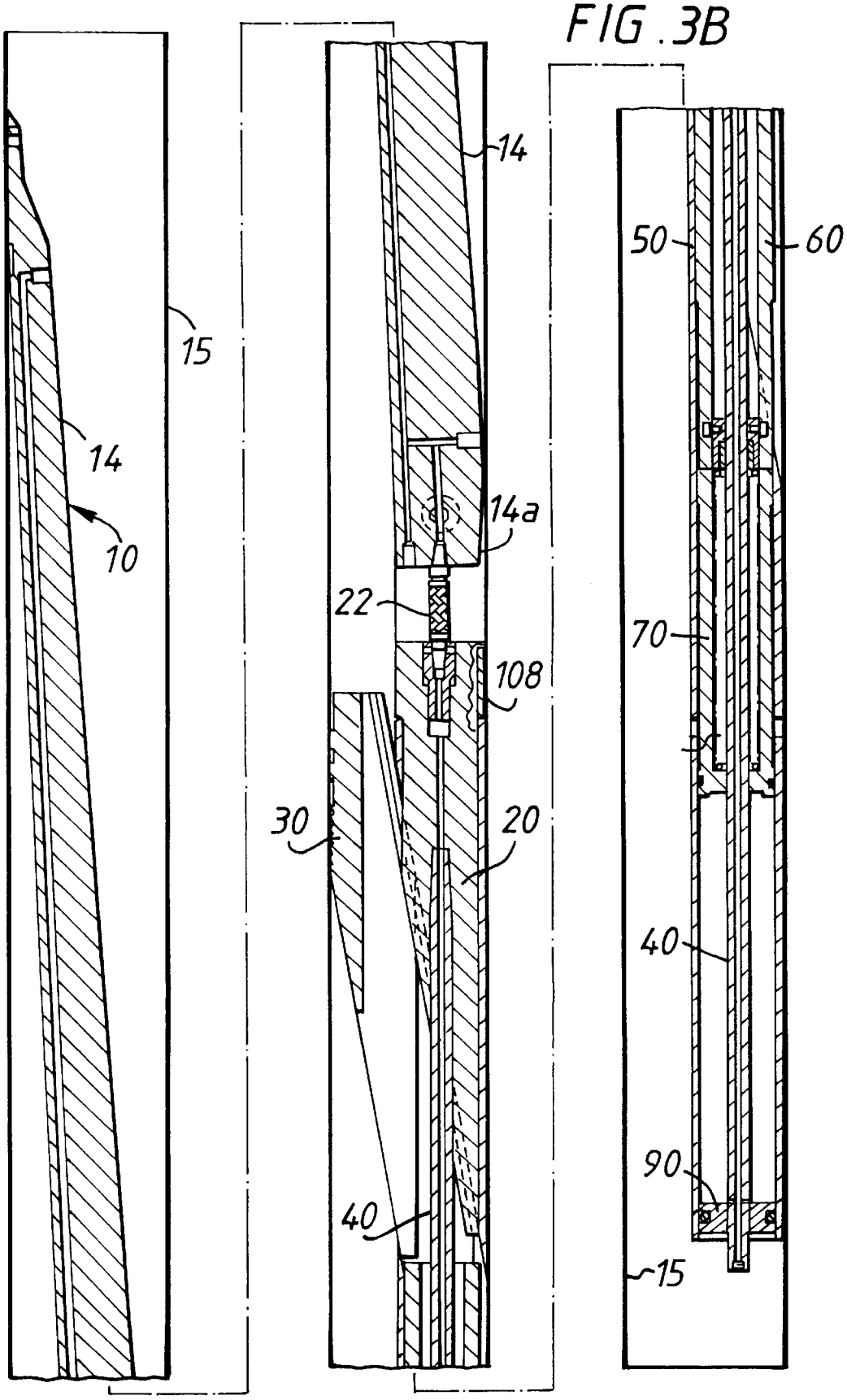
Figure 3C:
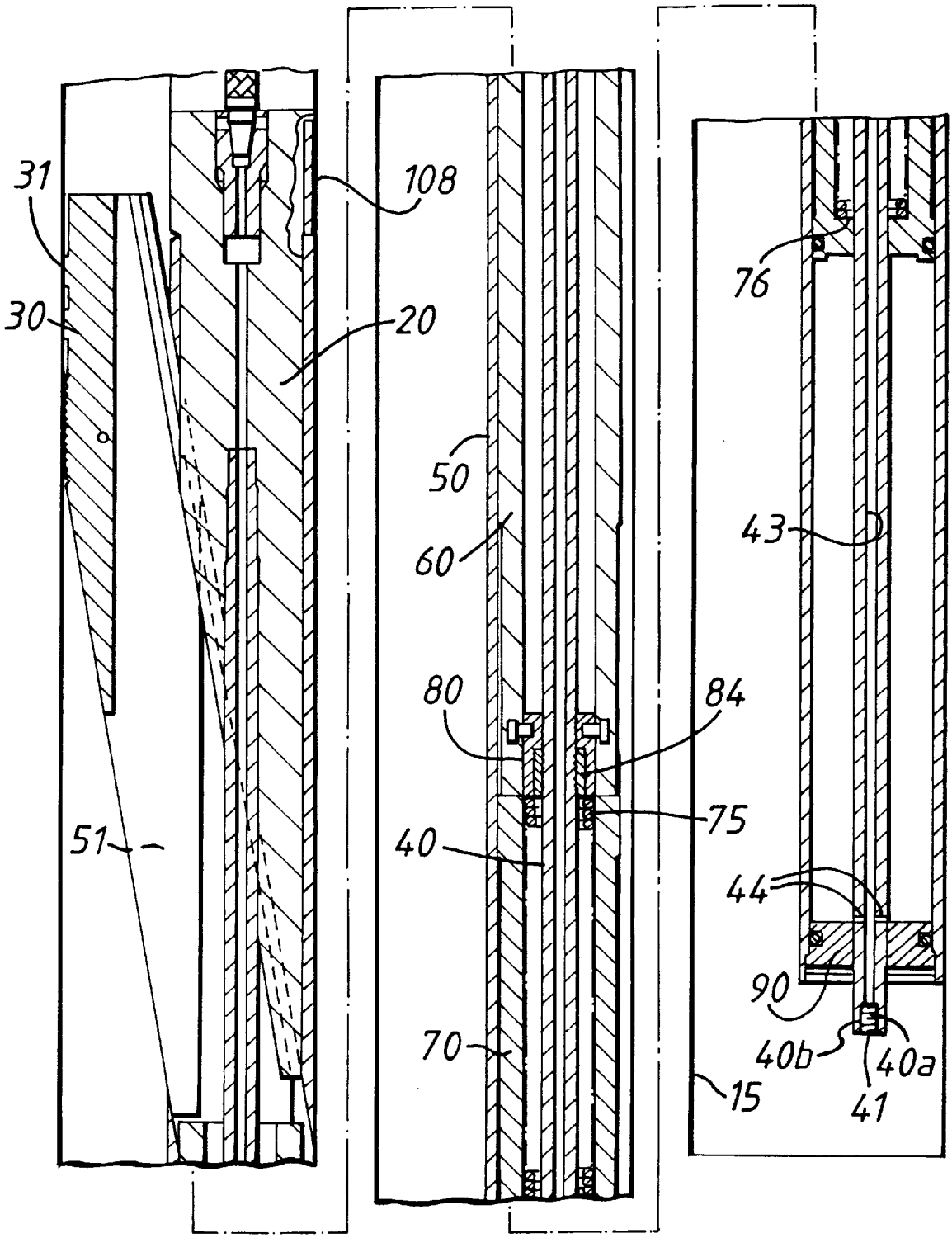

FIGS. 3A–3G show steps in an operation of the whipstock system 10. FIG. 3A shows the whipstock system 10 in a "running stage" as in FIG. 1 in which the system 10 is run into a wellbore W. In one operation the whipstock system 10 is run through a tubing string, e.g. with an internal diameter of 3.68" on coiled tubing with a running tool, or on a properly sized drill pipe string with a running tool. A high pressure fluid pumping system at the surface provides fluid, e.g. hydraulic fluid, at desired pressure levels to the system 10 which flows (see FIGS. 3B, 3C) to and through the concave 14, through the flexible hose 22 and down through a central fluid flow channel 43 of the mandrel 40 to exit ports 44. Fluid pressure builds up beneath the piston 70 and urges it and the ratchet body 80 upwardly against the pusher sleeve 60, which in turn pushes the slip 30 up, eventually with sufficient force to shear a shear pin 33 that releasably secures the slip 30 to the mandrel 40 and then outwardly from opening 51 of the anchor housing 50. The surface 31 of the slip 30 engages the inner wall of the casing 15 to anchor the system 10 within the casing 15. FIG. 3B shows the slip apparatus 30 moved out from the anchor housing 50 and abutting and set against the interior surface of the casing 15. A slight taper 14*a* on the lower end of the concave 14 has facilitated movement of the concave 14 against an opposite side of the casing 15 and the flexible hose 22 has flexed or bent to accommodate this movement of the concave 14.

As the ratchet body 80 is pushed up by the piston 70 and moves up around the mandrel 40, the ratchet teeth 88 ratchetingly engage corresponding teeth 48 (see FIGS. 4C, 4E) of the mandrel 40. This prevents the pusher sleeve 60 and the slip 30 from returning to a position in which the slip 30 does not engage the inner wall of the casing 15. In cases in which a string with a running tool is used to introduce the system 10 into a tubular string in a wellbore and move the system 10 through the tubular string, upon release of the running tool fluid pressure ceases through the system, the piston 70 no longer urges the pusher sleeve 60, and the latch 84 holds the pusher sleeve and thus the slip 30 in an engaged position.

As the piston 70 moves up, it compresses a spring 75 disposed about the mandrel 40, biased at a lower end against an internal shoulder 76 of the piston 70 and at an upper end against the latch 84. In one aspect the spring is sized and configured so that sufficient spring force is available when the spring is compressed between about ⅓ to 1 inch, and, in one aspect, about ½ inch.

Figure 3D:
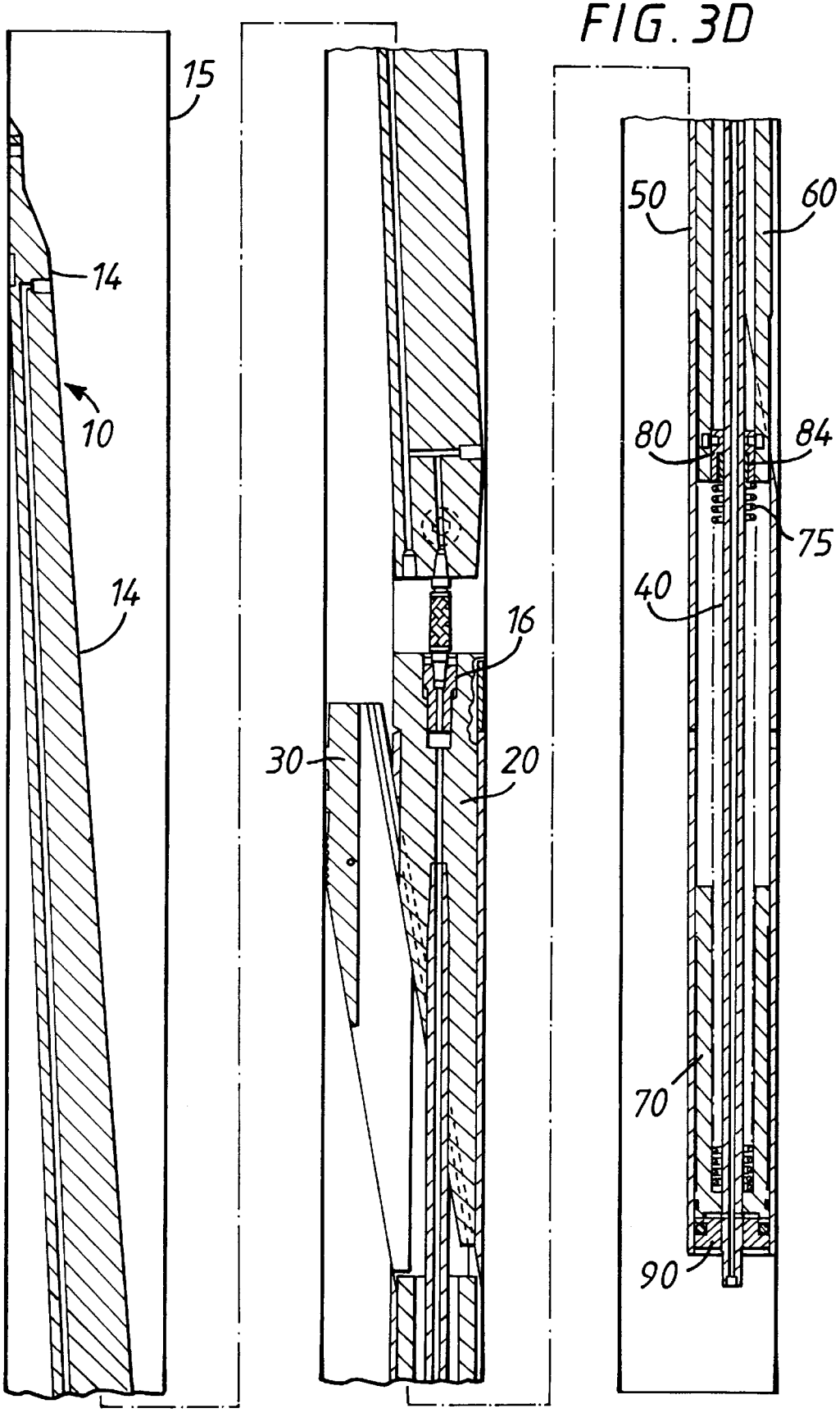
Figure 3E:
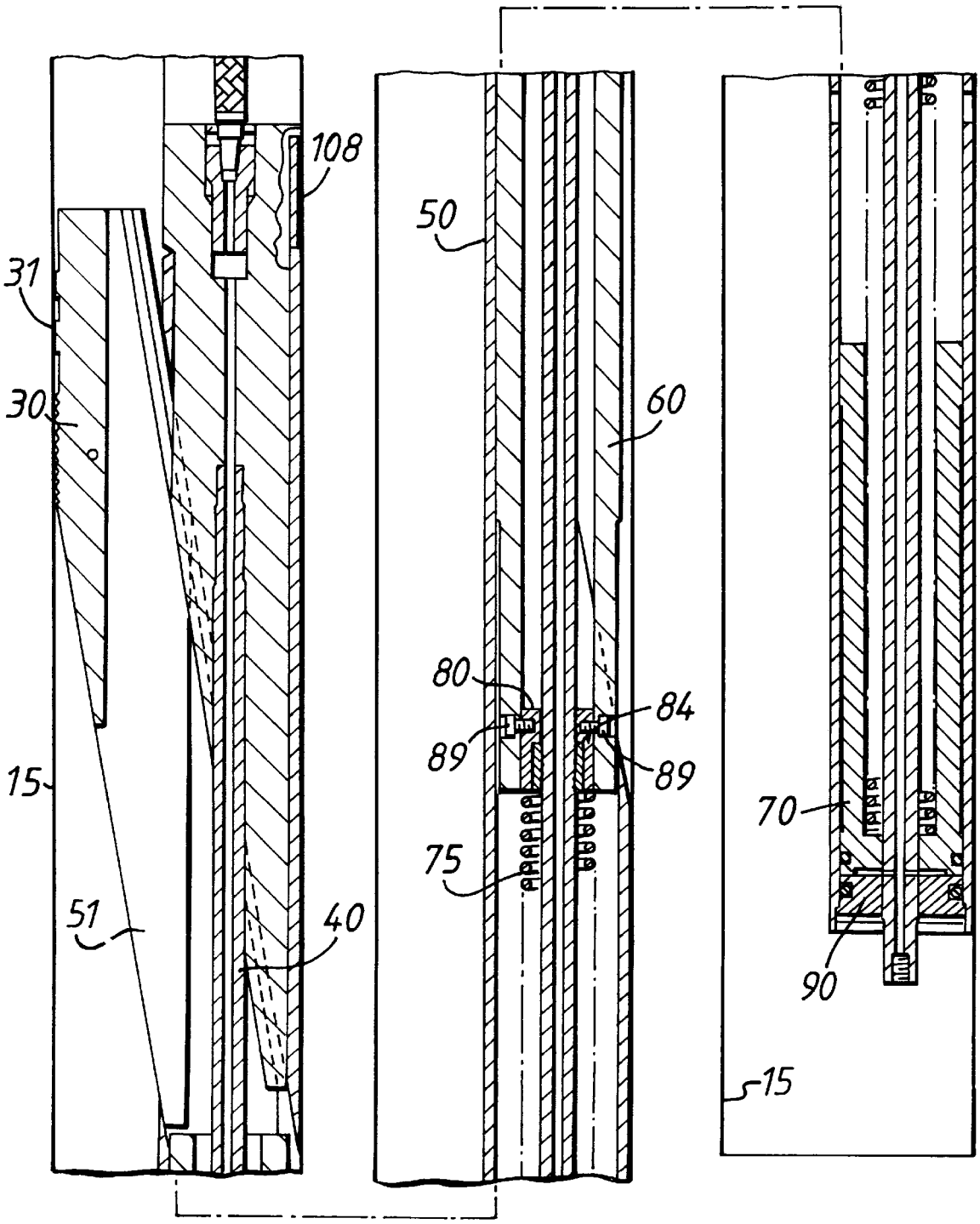

In a milling stage shown in FIGS. 3D and 3E, the spring 75 has pushed the piston 70 down (to the position of FIG. 1). In certain aspects, in a second trip, a mill or mill system uses the whipstock as a mill diverter and mills an opening or window through the casing 15 at a desired location. When fluid pressure is released (e.g. surface pump system is turned off) the piston 70 moves down.

Figure 3F:
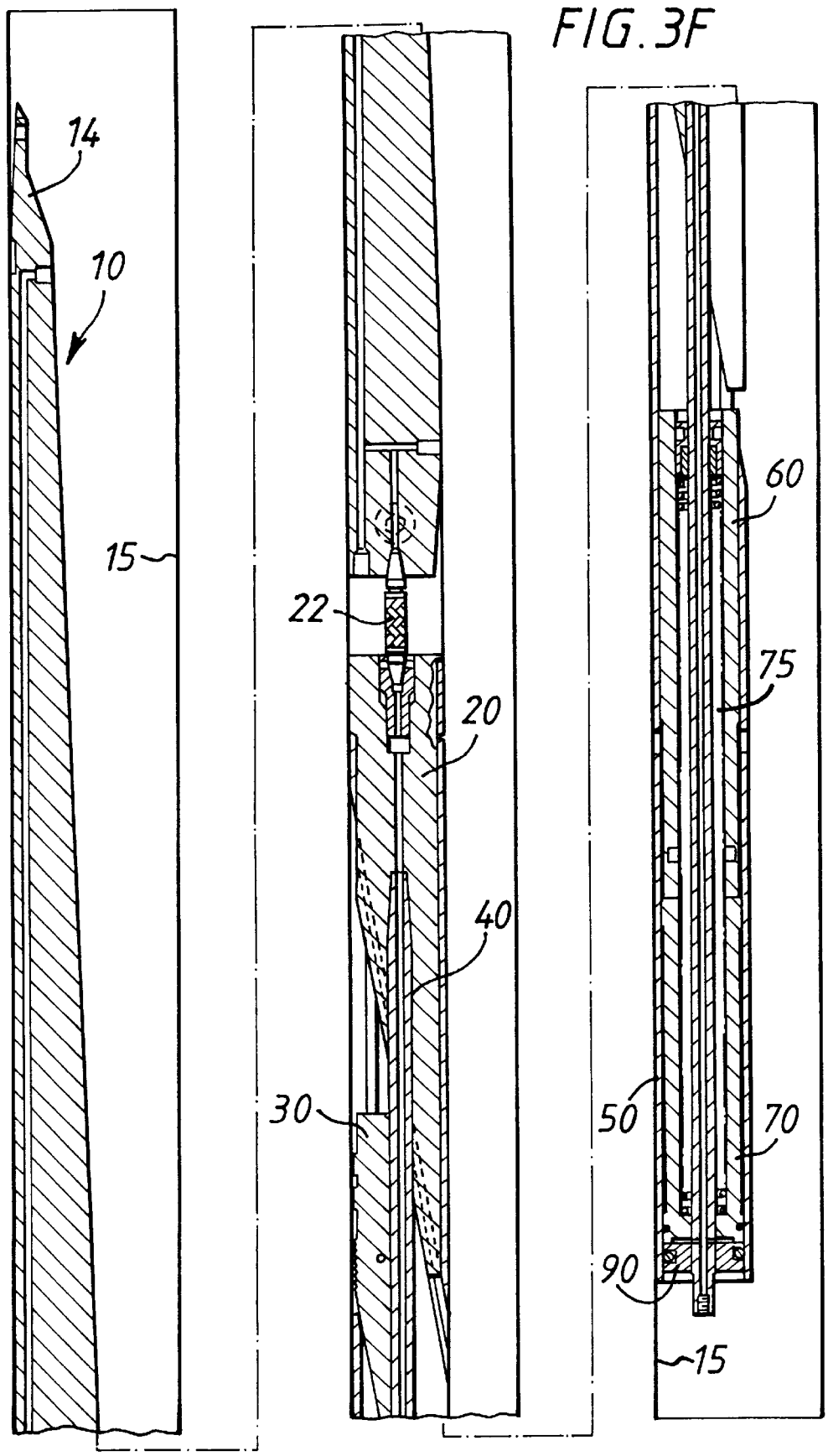
Figure 3G:
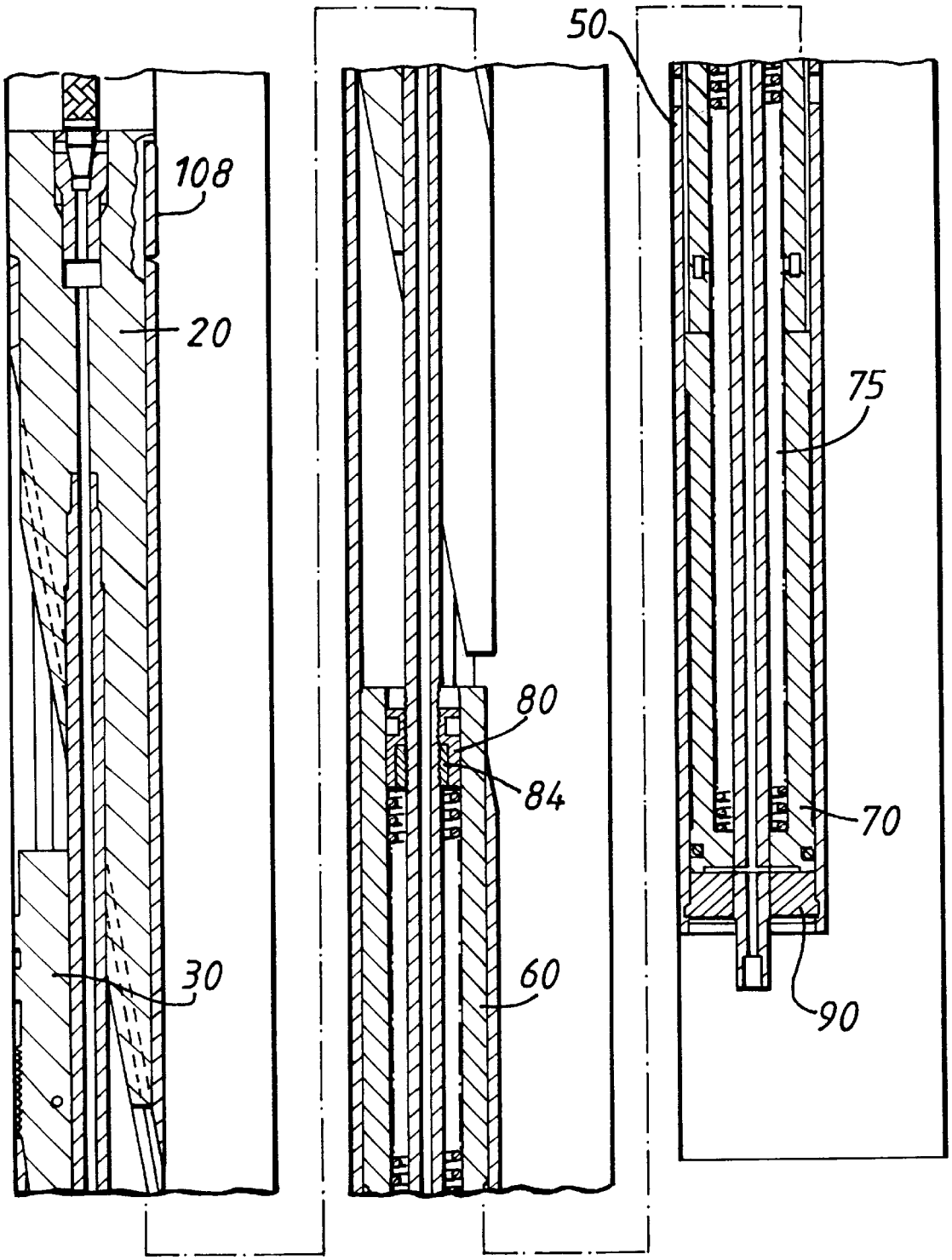

FIGS. 3F and 3G show a releasing stage of the operation in which a retrieval tool or overshot engages the top of the concave to remove the system 10 from the casing 15 and from the wellbore W (shown in FIG. 3A). A retrieval tool according to the present invention, e.g. as shown in FIG. 16A, may also be used. An upward pull on the system 10 and/or one or more "jarring" steps applied thereto, e.g. with any well-known jar device, breaks the pins 89 that releasably hold the latch 84 and the ratchet body 80, freeing the pusher sleeve 60 for downward movement with respect to the anchor housing 50 and the anchor housing 50 for upward movement with respect to the pusher sleeve 60. This in turn permits the slip 30 to re-enter the opening 51 and disengage from contact with the interior of the casing 15.

As shown in FIGS. 3F and 3G, the latch 84 remains in place on the mandrel 40 and the pusher sleeve 60 and piston 70 are again in contact with the slip 30 within the anchor housing 50 the system 10 assumes the original smaller overall outer diameter along its length that permits it to move through the smaller diameter tubing string within the casing 15.

Figures 4A, 4B, 4C, 4D:
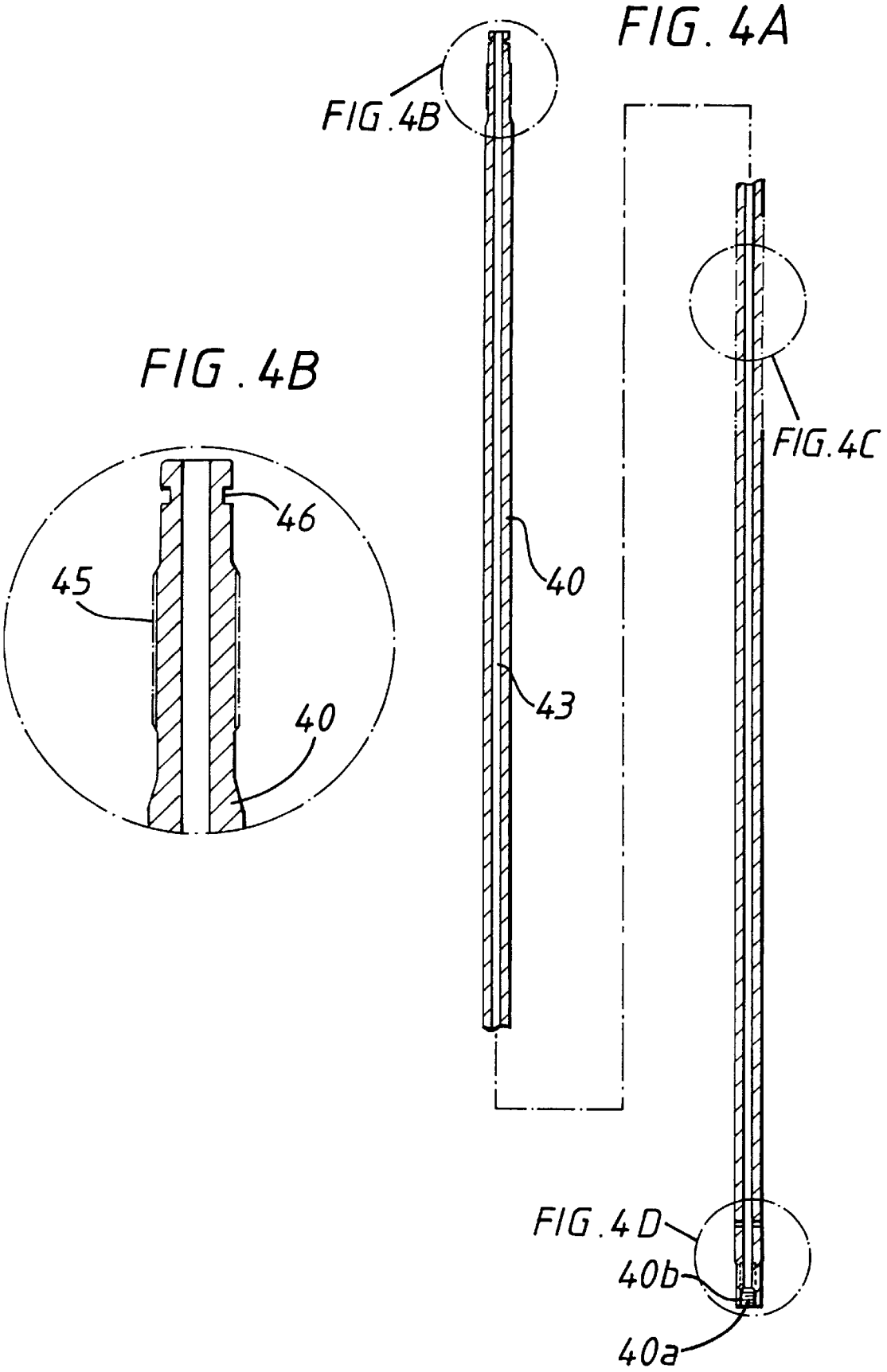

FIGS. 4A–4D show the mandrel 40 and portions thereof. FIG. 4B shows an O-ring groove 46 and a stub acme thread 45. FIG. 4E shows the ratchet teeth (or buttress threading) 48 that co-act with the teeth 88 of the latch 84.

Figure 5A:
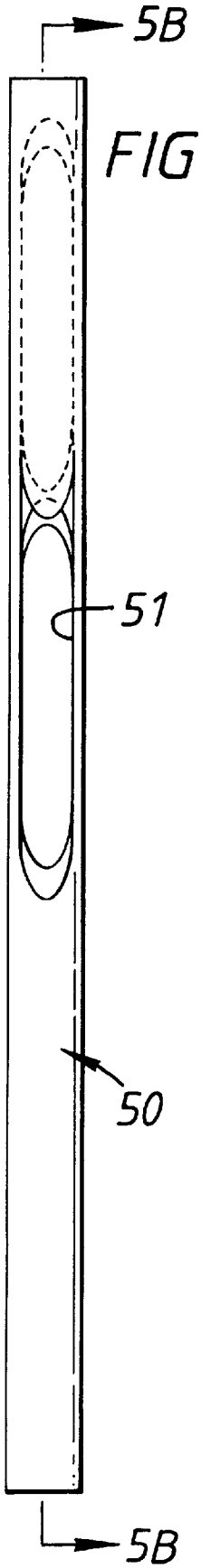
FIG. 5A is an enlarged top view and FIG. 5B is an enlarged cross-sectional side view of an anchor housing of the system of FIG. 1.
Figure 5B:
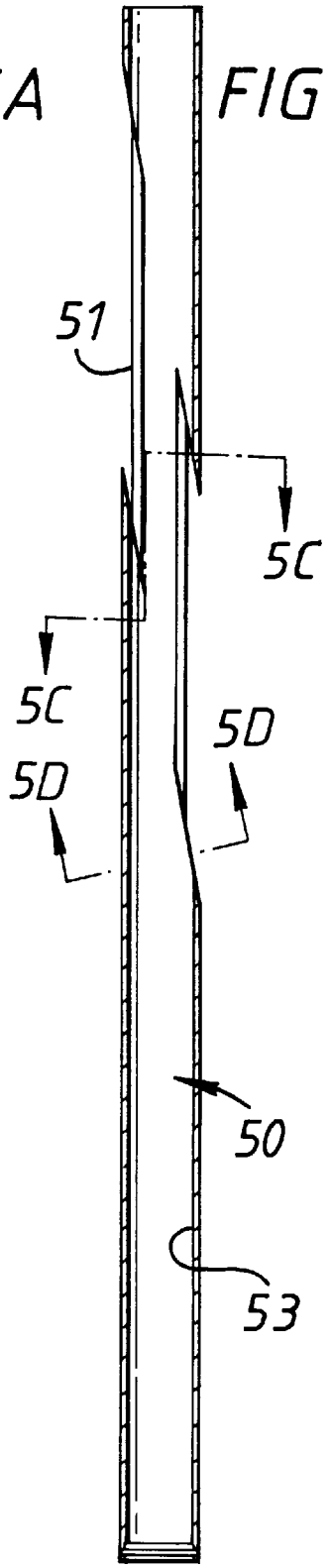
Figure 5C:
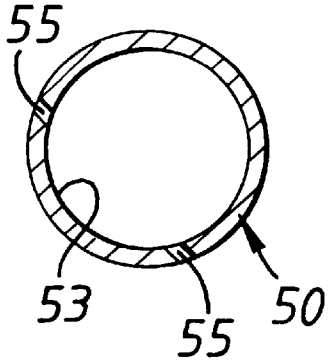
FIG. 5C is a view along line 5C—5C of FIG. 5B.
Figure 5D:
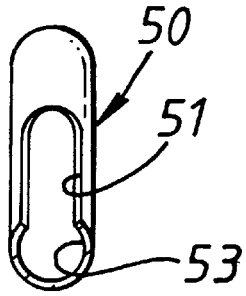
FIG. 5D is a view along line 5D—5D of FIG. 5B.
Figure 6A:
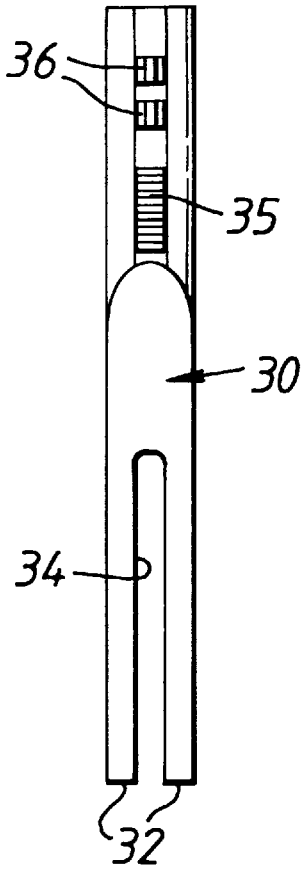
FIG. 6A is an enlarged bottom view of a slip of the system of FIG. 1.
Figure 6B:
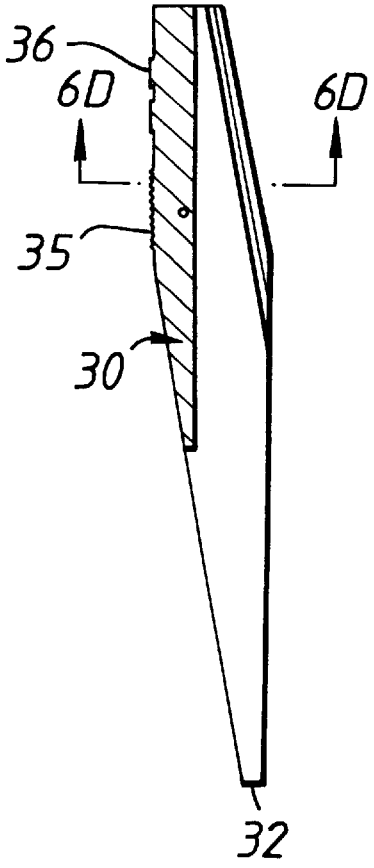
FIG. 6B is an enlarged side cross-sectional view of the slip of FIG. 6A along line 6B—6B of FIG. 6C.
Figure 6C:
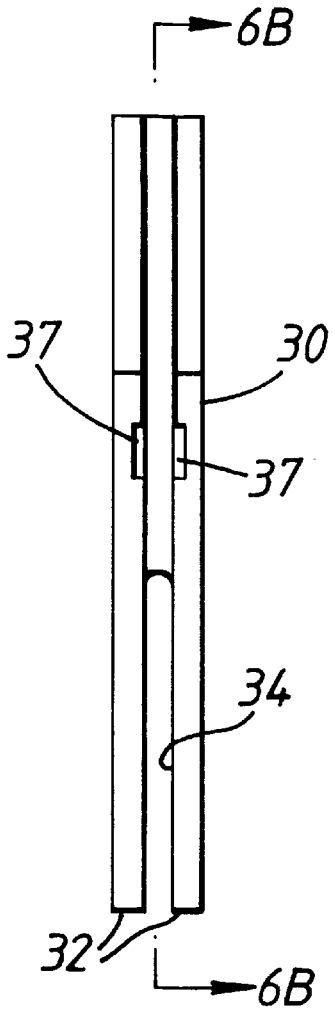
FIG. 6C is a top view of the slip of FIG. 6A.
Figure 6D:
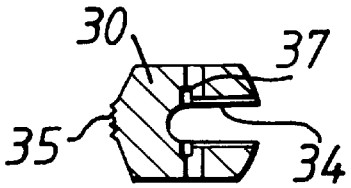
FIG. 6D is a view along line 6D—6D of FIG. 6B.

FIG. 5C shows the holes 55 through which one or more shear pins 55*a* that releasably hold the slip 30 to the housing 50. The pins 55*a* extend from holes 55*a* (FIG. 2B) into holes 35*a* (FIG. 2A) of the slip 30.

FIGS. 6A–6D show the slip 30 with a slot 37 that moves on a corresponding T-shaped member 28 (see FIG. 7E) of the anchor body 20 as the slip exits the anchor housing 50.

FIGS. 7A–7G show the anchor body 20 and parts thereof. Slips 108 have a dovetail end that fits in dovetail slots 26. A slot 24 facilitates connection of the anchor body to the concave 14 with bolts through holes 25. The male T 28 co-acts with the female T-shape of the slot 37 of the slip 30.

Figure 8:
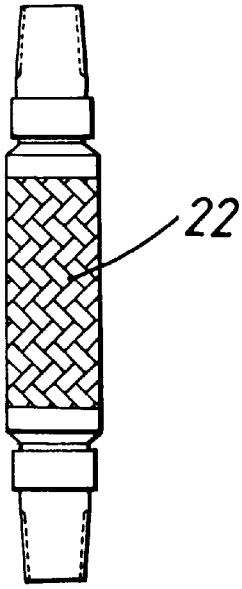
FIG. 8 is a side view of a prior art flexible hose used with the system of FIG. 1.

FIG. 8 shows one embodiment of a flexible hose 22. In one aspect such a hose is a flexible metallic hose as is commercially available from Swagelok Hose Products. Alternatively a rigid or bendable tubular member may be used instead of the hose 22 or any connection or connection system that allows the required relative movement of parts.

Figure 9:
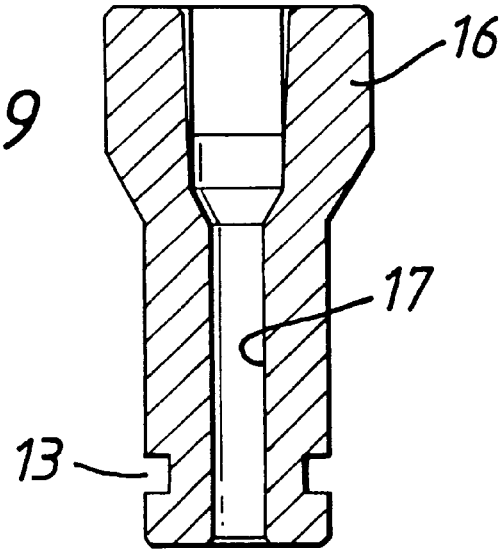
FIG. 9 is a side cross-sectional view of a hose adapter used with the hose of FIG. 8.

FIG. 9 shows a hose adapter 16 with a channel 17 therethrough used with the hose 22. The adapter 16 has a recess 13 for an O-ring to seal the adapter/anchor body interface.

Figure 7A:
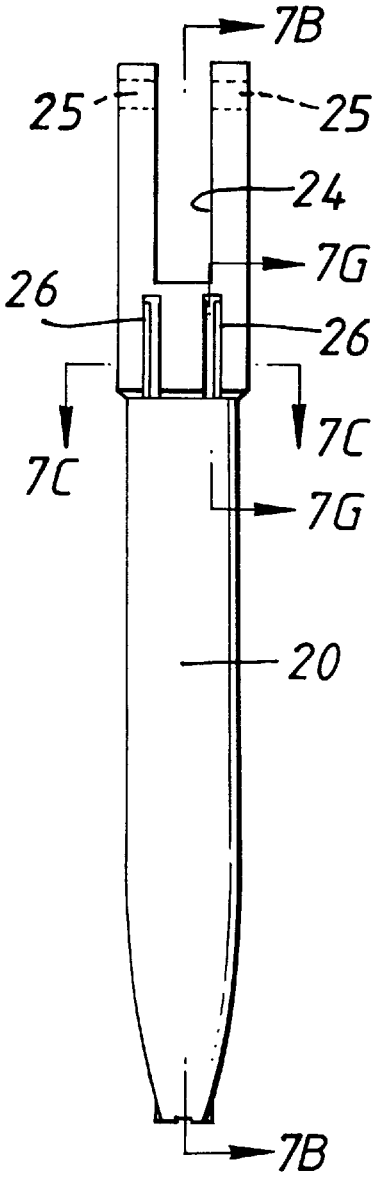
FIG. 7A is an enlarged top view of an anchor body of the system of FIG. 1.
Figure 7B:
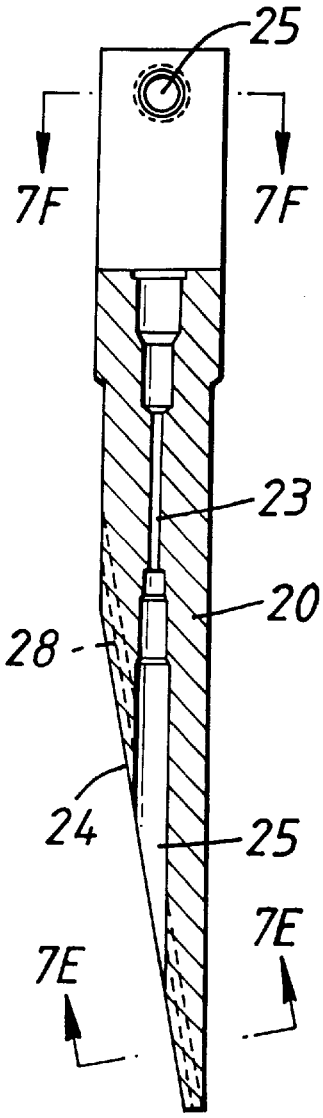
FIG. 7B is an enlarged side cross-sectional view of the anchor body of FIG. 7A.
Figure 7C:
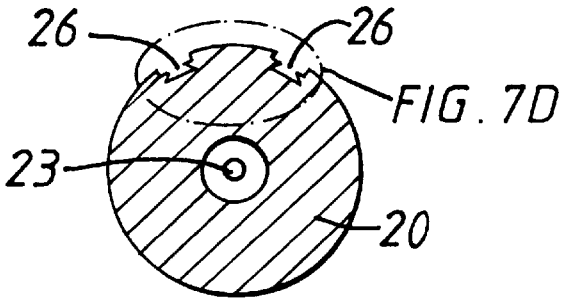
FIG. 7C is a view along line 7C—7C of FIG. 7A.
Figure 7D:
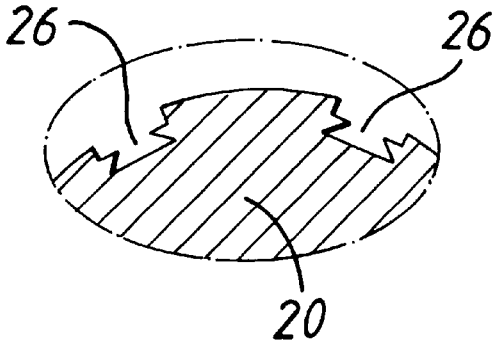
FIG. 7D is an enlargement of part of the system as shown in FIG. 7B.
Figure 7E:
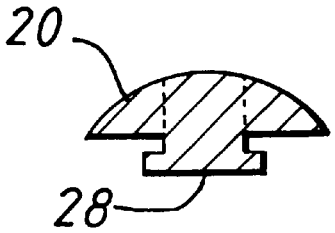
FIG. 7E is a view along line 7E—7E of FIG. 7B.
Figure 7F:
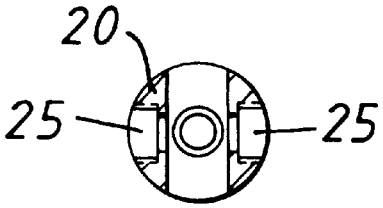
FIG. 7F is a view along line 7F—7F of FIG. 7B.
Figure 7G:
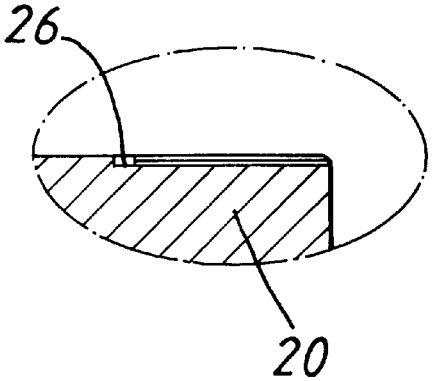
Figure 10A:
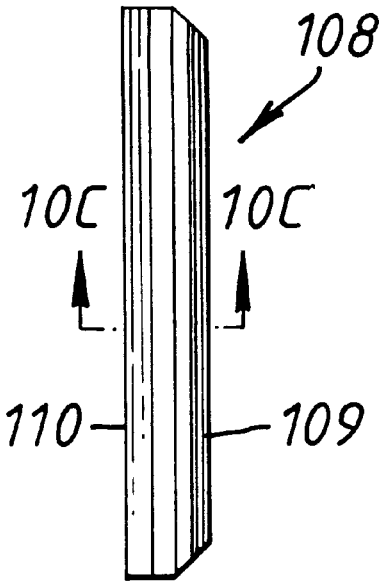
FIG. 10A is a side view of a slip of the system of FIG. 1.
Figure 10B:
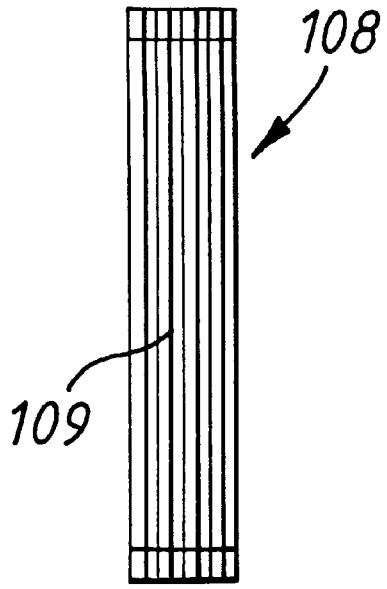
FIG. 10B is top view of the slip of FIG. 10A.
Figure 10C:
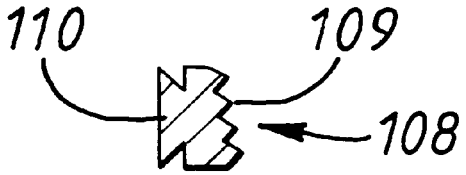
FIG. 10C is view along line 10C—10C of FIG. 10A.

FIGS. 10A–10C show a small slip 108 with a dovetail end 110 that is received and held in the correspondingly shaped slots 26 in the anchor body 20 (see FIG. 7C). These small slips 108 engage an interior portion of the casing 15 opposite the portion engaged by the slip 30. As with the surface 31, a surface 109 may have any known type of teeth and/or gripping surface, marking and/or non-marking.

Figure 11A:
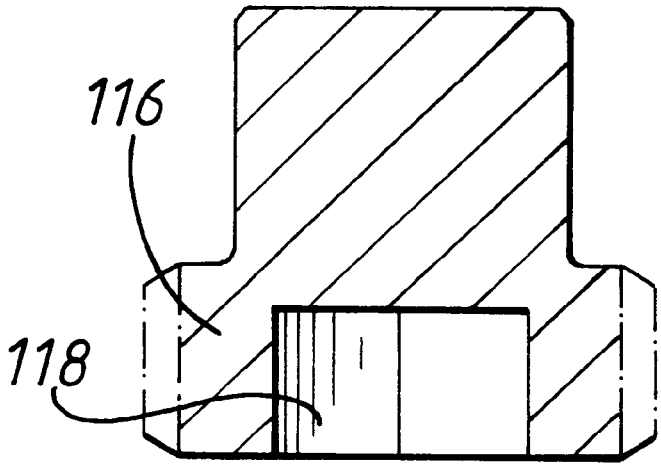
FIGS. 11A is a side cross-sectional view of an anchor bolt of the system of FIG. 1.
Figure 11B:
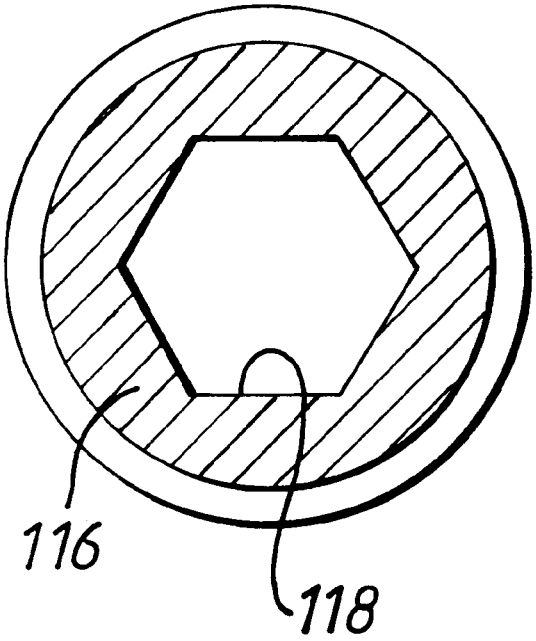
FIG. 11B is a bottom view along of the bolt of FIG. 11A.

FIGS. 11A and 11B show an anchor bolt 116 with a hex recess 118. Such bolts are used to joint the concave 14 to the anchor body 20.

FIGS. 12A–12E show a retrieval tool 130 according to the present invention for retrieving a whipstock or whipstock system from a wellbore; and, in one aspect, for retrieving a whipstock system 10 from a wellbore. The retrieval tool 130 has a body 132 with a channel 150 therethrough from top to bottom. A spring 152 has a top end 158 biased against a shoulder 160 of the channel 150 and a lower end 162 biased against a member 154. The member 154 has a channel 156 therethrough from top to bottom for fluid flow and a lower end 164. The fluid flow facilitates removal of debris, etc. from the concave C.

A piston 138 is movably mounted in a channel 148 and urged outwardly (downwardly in FIG. 12) by a spring 146 positioned in the channel 148 above the piston 138. A sleeve 134 encompasses the piston 138 and the member 154 and is connected to the body 132 e.g. by welding and/or by threaded engagement.

A dog 144 partially in a slot 142 of the piston 138 and partially in a slot 166 of the member 154 initially releasably holds the piston 138 and the member 154 immobile.

A muleshoe profile 168 as is commonly known may be provided in the member 154 to contact a top of a concave C to facilitate correct orientation of the lip 136 of the tool 130 with respect to a slot S of the concave C in casing G in a wellbore W that is to be retrieved. The lip 136 of the sleeve 134 is sized, configured and positioned for receipt within the lip slot S of the concave C. (The concave C may be a concave of any known whipstock, or it may be like the concave of any whipstock disclosed herein). The concave C has a surface F. The member 154 is initially releasably held by the dog 144.

Figure 12A:
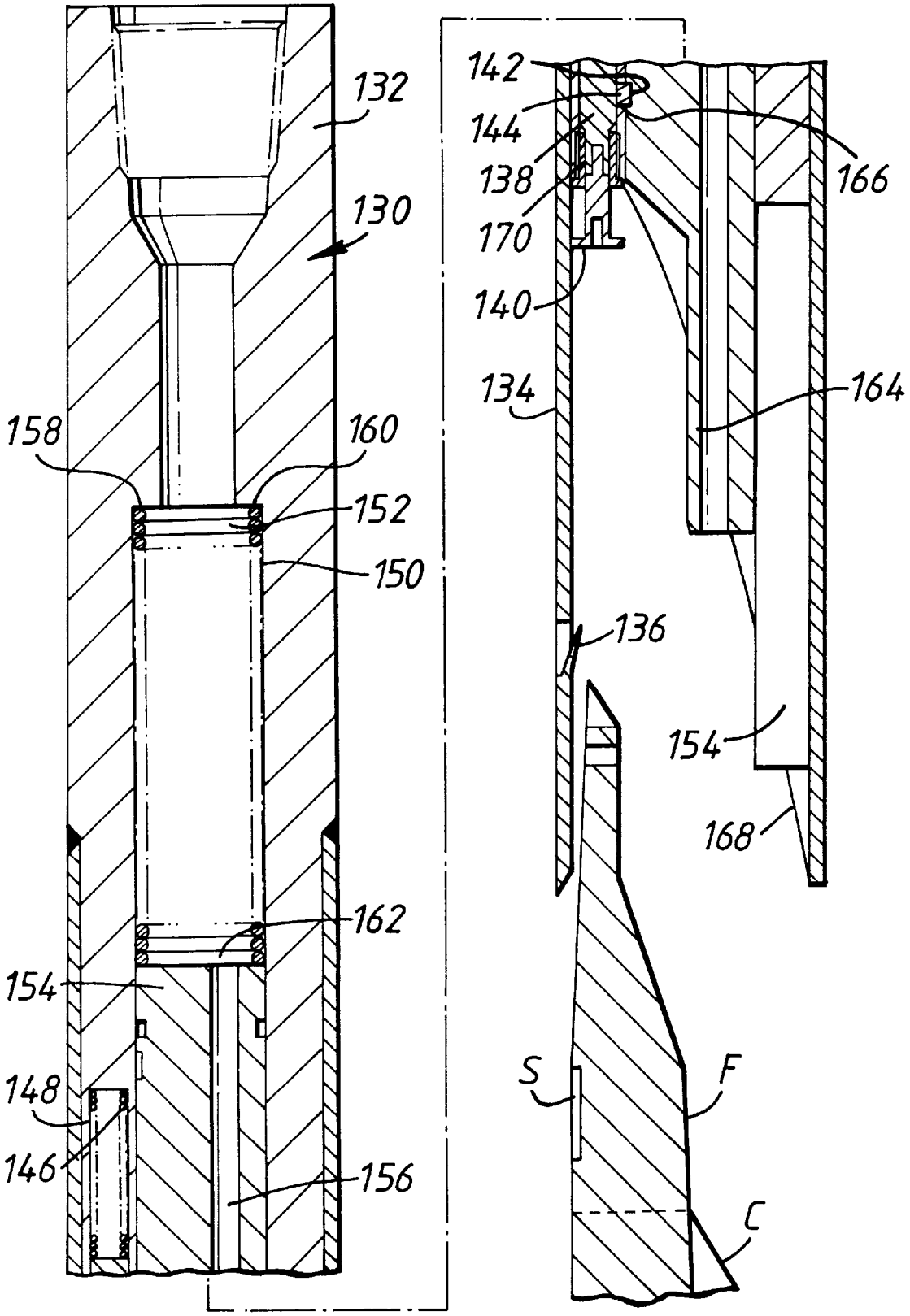
FIG. 12A is a side cross-sectional view of a whipstock and whipstock retrieval tool according to the present invention.
Figure 12B:
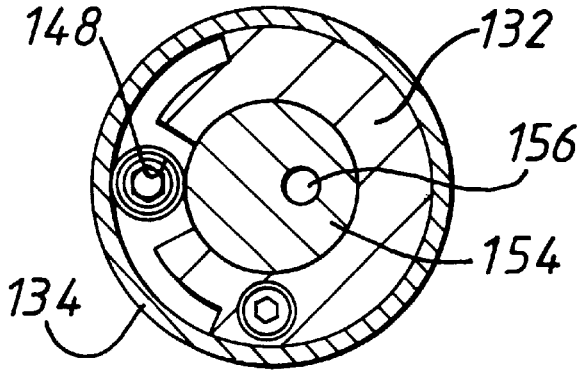
FIGS. 12B–12E are cross-sectional views at the level of the apparatus of FIG. 12A at which they are disposed in the drawing.
Figure 12C:
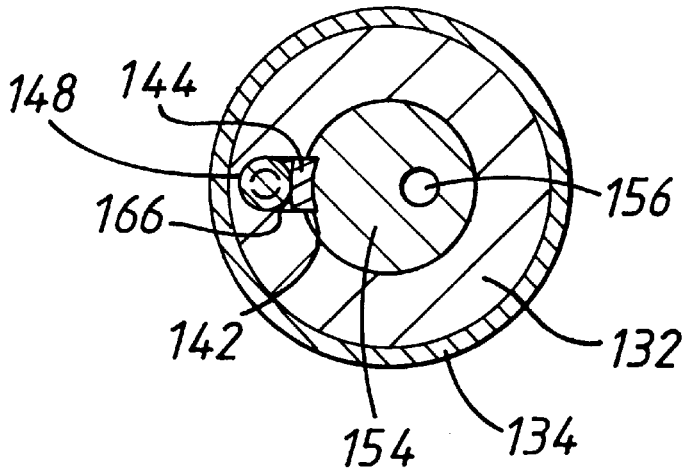
Figure 12D:
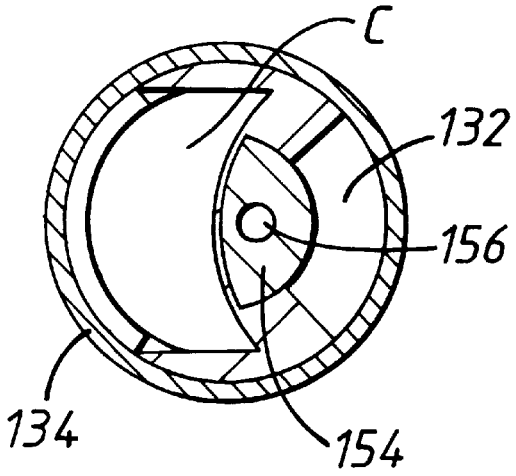
Figure 12E:
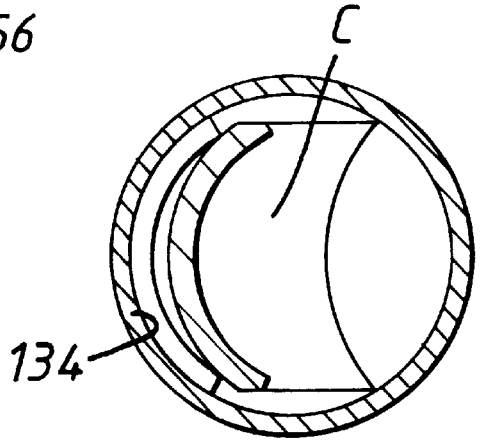
Figure 12F:
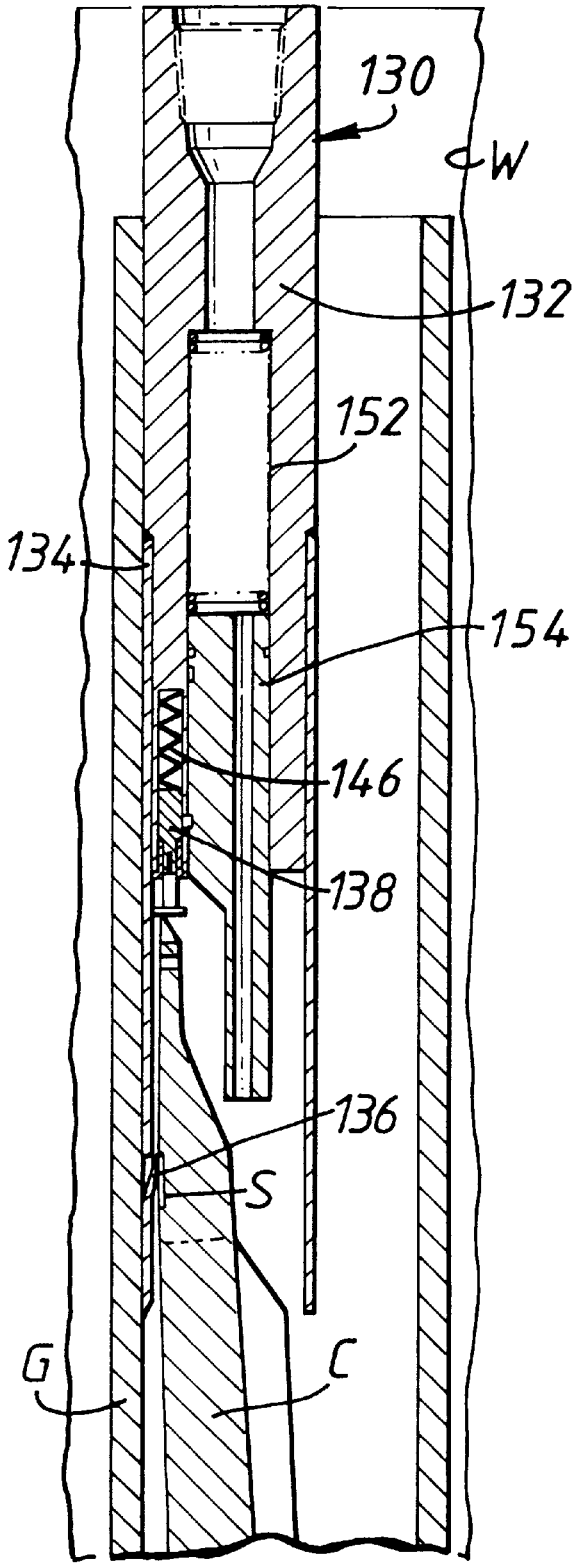
FIGS. 12G–12H show steps in the operation of the apparatus of FIG. 12A.

FIG. 12F shows the tool 130 moved down with the bottom end of the sleeve 134 around a top portion of the concave C and the lip 136 prepared to enter the slot S. The end 140 of the piston 138 has contacted the top of the concave C.

Figure 12G:
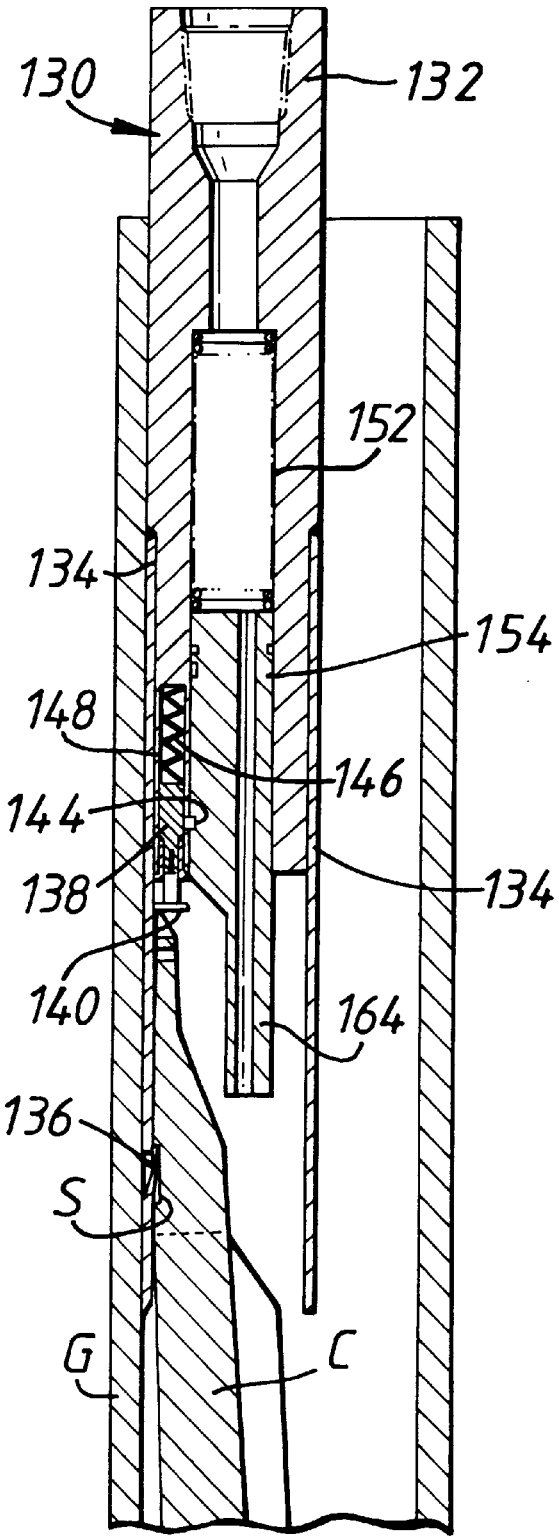

As shown in FIG. 12G, the lip 136 has entered the slot S and force is being applied to the piston 138.

Figure 12H:
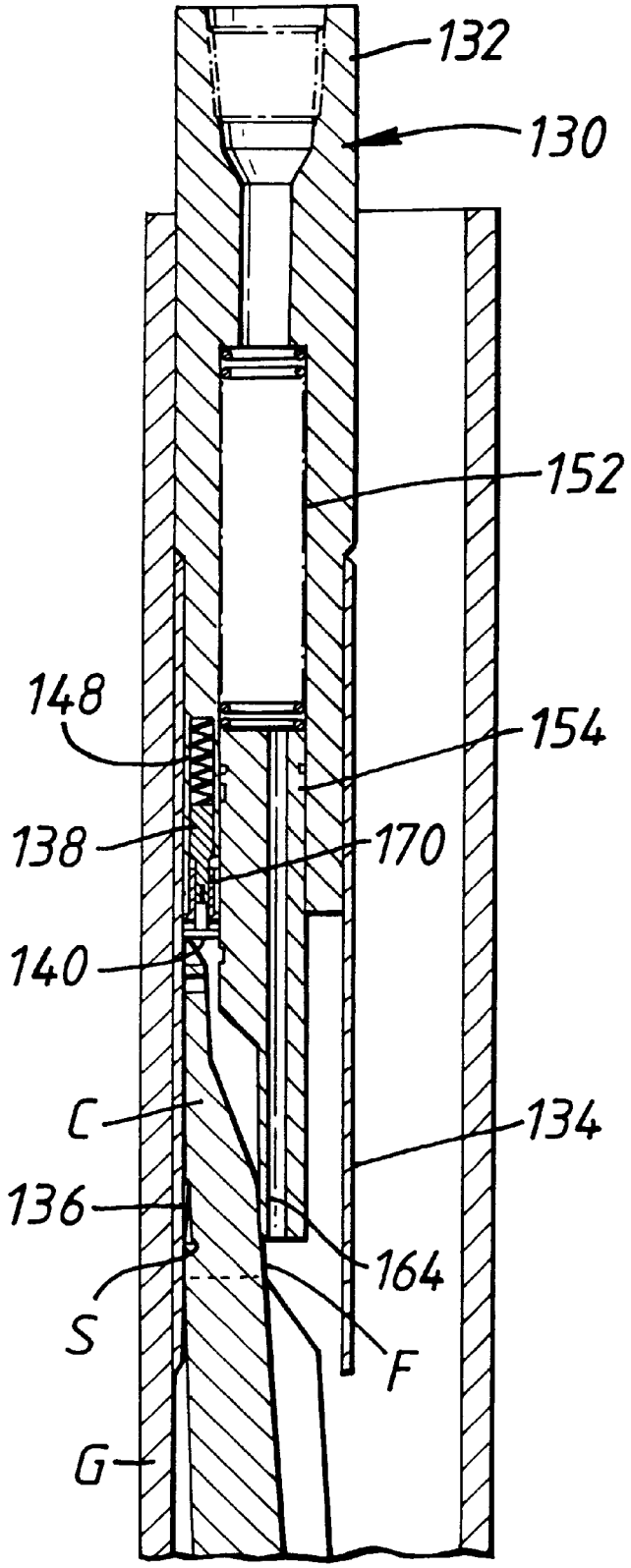

As shown in FIG. 12H, the dog 144 has been released from the slot 166 by moving adjacent and into a reduced diameter portion or slot 120 of the piston 138, thus freeing the piston 138 to move up in the channel 148 and freeing the member 154 which is urged down by the spring 152 so that a lower end 164 of the member 154 abuts the surface F of the concave C, thereby stabilizing the tool 130 on the concave C. The lip 136 in the slot S stabilizes the concave in the up-down direction and the end 164 stabilizes it in the side-to-side direction. Retrieval of the concave C is now effected by pulling upon a string to which the tool 130 is connected. The string may be a string of drill pipe or coiled tubing (see, e.g. coiled tubing string CT shown schematically, FIG. 3A and to which the system is releasably connected by any known suitable connection apparatus CA) and may include a jar and/or a swivel.

When using the tool 130 with the system 10 of Fig., following securement of the tool 130 to the concave 14, application of an upward force through the string to which the system 10 is attached shears the pins 89 (e.g. at about 30,000 lbs) freeing the pusher sleeve 60 to move down (FIG. 3G) and allowing the slip 30 to retract within the housing 50.

Thus the present invention, in certain aspects, provides a through-tubing retrievable whipstock which can be set at any desired location in a wellbore or within a tubular string, such as, but not limited to, a casing string, in a wellbore. In one aspect the system is hydraulically set and mechanically released (e.g. the system 10).

In one operation according to this invention, a system 10 according to the present invention is inserted into and through tubing which has been run into casing in a wellbore. The system 10 is at the end of a string as previously described and descends through the tubing, exiting the tubing and entering casing within the wellbore. The system is lowered to a desired point in the casing.

The present invention, therefore, provides, in at least certain embodiments, a whipstock system for insertion into an earth wellbore through a first tubular into a second tubular and for selectively setting within the second tubular, the first tubular having a smaller internal diameter than the second tubular and the first tubular disposed above the second tubular, the second tubular having an interior surface, the whipstock system having a concave, anchor apparatus connected to and below the concave, grip apparatus movably disposed within the anchor apparatus, pushing apparatus below the grip apparatus for pushing the grip apparatus upwardly and outwardly from the anchor apparatus for contacting the interior surface of the second tubular to set the whipstock system therein, and fluid flow apparatus for conducting fluid under pressure through the concave and through the anchor apparatus to push up on the pushing apparatus; such a whipstock system with one, some, or all of the following—the grip apparatus having a grip mating apparatus and the anchor apparatus including an anchor body above the grip apparatus, and anchor body mating apparatus for acting with the grip mating apparatus to guide movement of the grip apparatus with respect to the anchor apparatus; the anchor apparatus including an anchor housing within which the grip apparatus is initially located, and grip releasable apparatus releasably holding the grip apparatus to the anchor housing; wherein the grip apparatus is movable out from the anchor apparatus to set the whipstock system and is then movable back into the anchor apparatus to facilitate retrieval of the whipstock system from the earth wellbore; the anchor apparatus including an anchor body above the grip apparatus, the anchor body having a fluid flow channel therethrough, the anchor body below and spaced apart from a lower end of the concave, the concave having a fluid flow channel therethrough, and flexible fluid flow member interconnecting and in fluid communication with the fluid flow channel of the concave and the fluid flow channel of the anchor body; wherein the grip apparatus is movable out from the anchor apparatus to push the anchor apparatus against a first part of the interior surface of the second tubular causing the concave to move against a second part of the interior surface of the second tubular spaced apart from the first part; holding apparatus for holding the pushing apparatus up against the grip apparatus to maintain setting of the whipstock system; wherein the holding apparatus is releasably secured to the pushing apparatus for selective release thereby allowing the pushing apparatus to move down and away from the grip apparatus so that the grip apparatus is movable back into the anchor apparatus to un-set the whipstock system; wherein the holding apparatus includes a central mandrel connected to the anchor apparatus and running through a central channel through the pushing apparatus, the central mandrel having a portion with mandrel ratchet teeth, and the pushing apparatus having a portion with pushing apparatus ratchet teeth for ratchetingly acting with the mandrel ratchet teeth to prevent downward movement of the pushing apparatus while allowing upward movement thereof to push the grip apparatus out from the anchor apparatus; wherein the portion of the pushing apparatus having the pushing apparatus ratchet teeth is a separate part releasably secured to the pushing apparatus for selective disengagement therefrom to free the pushing apparatus from the central mandrel permitting downward movement of the pushing apparatus and un-setting of the grip apparatus; a central mandrel connected to the anchor apparatus and having a top end and a bottom end, the anchor apparatus including an anchor housing within which is disposed an anchor body positioned above the grip apparatus, the slip apparatus initially disposed within the anchor housing above the pushing apparatus, the anchor housing having a sealed-off lower end, the pushing apparatus including a pusher sleeve below the grip apparatus and a piston below the pusher sleeve, the central mandrel extending down from the anchor body, through the grip apparatus, through the pushing apparatus, and through the piston, a fluid flow channel through the whipstock system including channels through concave, through a member interconnecting the concave and the anchor body, and through the central mandrel, and fluid flowable under pressure from earth surface to the whipstock system, through the fluid flow channel, and out through at least one lower exit port at the bottom end of the central mandrel beneath the piston to force the piston and thereby the pusher sleeve upwardly to move the grip apparatus from the anchor housing to set the whipstock system within the second tubular; wherein the first tubular comprises a string of tubing and the second tubular comprises a string of casing, both strings disposed in an earth wellbore and extending down into the wellbore from an earth surface; at least one auxiliary grip member on the anchor apparatus spaced radially apart from the slip apparatus; wherein the system is tubular string is coiled tubing; wherein the grip apparatus is from the group consisting of slip apparatus and non-marking gripping apparatus; a retrieval tool releasably connected to the whipstock system for removing the whipstock system from the earth wellbore; wherein the concave has a top lip slot and a concave surface and wherein the retrieval tool has a body, a hollow sleeve connected to and with a portion extending down beyond the body, the sleeve having an inner lip for receipt within the top lip slot of the concave, a movable member selectively releasably held within a body channel in the body, a spring in the body channel urging the movable member outwardly therefrom, holding apparatus releasably holding the movable member within the body channel, and the movable member movable out from the body channel upon release of the holding apparatus to contact the concave surface to stabilize the retrieval tool on the concave; wherein the holding apparatus comprises a piston movably disposed with a piston channel of the body, the piston releasably connected to the movable member and positioned for contact by a top of the concave so that force on the piston releases the piston from the movable member thereby freeing the movable member for movement by the spring; and/or wherein the piston has a reduced diameter portion and a dog initially has part thereof disposed in a slot in the movable member and part thereof disposed in a corresponding slot of the piston to releasably hold the movable member, movement of the piston by contact with the top of the concave moving the reduced diameter portion of the piston adjacent the dog permitting the dog to move away from the movable member thereby freeing the movable member for downward movement with respect to the concave.

The present invention, therefore, provides, in at least certain embodiments, a method for setting a whipstock system in a second tubular in an earth wellbore, the whipstock system comprising a concave, anchor apparatus connected to and below the concave, grip apparatus movably disposed within the anchor apparatus, pushing apparatus below the grip apparatus for pushing the grip apparatus upwardly and outwardly from the anchor apparatus for contacting the interior surface of the second tubular to set the whipstock system therein, and fluid flow apparatus for conducting fluid under pressure through the concave and through the anchor apparatus to push up on the pushing apparatus, the method including introducing fluid under pressure through the fluid flow apparatus to move the pushing apparatus, and setting the grip apparatus by moving the pushing apparatus upwardly; such a method with a system with further apparatus as mentioned above, including one, some or all of the following—moving the grip apparatus back into the anchor apparatus; and retrieving the whipstock system from the earth wellbore; selectively and releasably holding the pushing apparatus up against the grip apparatus; moving the grip apparatus out from the anchor apparatus to push the anchor apparatus against a first part of the interior surface of the second tubular and thereby moving the concave against a second part of the interior surface of the second tubular spaced apart from the first part.

The present invention, therefore, provides, in at least certain embodiments, an anchor apparatus for anchoring a wellbore item in a tubular member or in a wellbore, the anchor apparatus having a concave, anchor apparatus connected to and below the concave, grip apparatus movably disposed within the anchor apparatus, pushing apparatus below the grip apparatus for pushing the grip apparatus upwardly and outwardly from the anchor apparatus for contacting the interior surface of the second tubular to set the whipstock system therein, and fluid flow apparatus for conducting fluid under pressure through the concave and through the anchor apparatus to push up on the pushing apparatus; such an anchor apparatus with one, some or all of the following—an anchor housing within which the grip apparatus is initially located; grip releasable apparatus releasably holding the grip apparatus to the anchor housing; the grip apparatus movable out from the anchor apparatus to set the whipstock system and is then movable back into the anchor apparatus to facilitate retrieval of the whipstock system from the earth wellbore; the grip apparatus movable out from the anchor apparatus to push the anchor apparatus against a first part of the interior surface of the second tubular causing the concave to move against a second part of the interior surface of the second tubular spaced apart from the first part; holding apparatus for holding the pushing apparatus up against the grip apparatus to maintain setting of the whipstock system; and/or the grip apparatus having slip apparatus.

The present invention, therefore, provides, in at least certain embodiments, a retrieval tool for retrieving an item from a wellbore, the item having an item lip slot, the retrieval tool having a body, a hollow sleeve connected to and with a portion extending down beyond the body, the sleeve having an inner lip for receipt within the item lip slot of the item, a movable member selectively releasably held within a body channel in the body, a spring in the body channel urging the movable member outwardly therefrom, holding apparatus releasably holding the movable member within the body channel, and the movable member movable out from the body channel upon release of the holding apparatus to contact the item to stabilize the retrieval tool on the item; and such a tool wherein the holding apparatus has a piston movably disposed with a piston channel of the body, the piston releasably connected to the movable member and positioned for contact by a top of the item so that force on the piston releases the piston from the movable member thereby freeing the movable member for movement by the spring, and the piston has a reduced diameter portion and a dog initially has part thereof disposed in a slot in the movable member and part thereof disposed in a corresponding slot of the piston to releasably hold the movable member, movement of the piston by contact with the top of the item moving the reduced diameter portion of the piston adjacent the dog permitting the dog to move away from the movable member thereby freeing the movable member for downward movement with respect to the item.

The present invention, therefore, provides, in at least certain embodiments, a slip with at lest two toothed surfaces, including at least a first toothed surface for resisting a force applied to the slip in a first direction and a second toothed surface for resisting a force applied to the slip in a second direction different from the first direction; and, in one aspect, such a slip that has teeth to resist torsion force and teeth to resist up and down force.

In conclusion, therefore, it is seen that the present invention and the embodiments disclosed herein and those covered by the appended claims are well adapted to carry out the objectives and obtain the ends set forth. Certain changes can be made in the subject matter described, shown and claimed without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A whipstock system for insertion into an earth wellbore through a first tubular into a second tubular and for selectively setting within the second tubular, the first tubular having a smaller internal diameter than the second tubular and the first tubular disposed above the second tubular, the second tubular having an interior surface, the whipstock system comprising a concave, anchor apparatus connected to and below the concave, grip apparatus movably disposed within the anchor apparatus, pushing apparatus below the grip apparatus for pushing the grip apparatus upwardly and outwardly from the anchor apparatus for contacting the interior surface of the second tubular to set the whipstock system therein, and fluid flow apparatus for conducting fluid under pressure through the concave and through the anchor apparatus to push up on the pushing apparatus, the anchor apparatus including an anchor body above the grip apparatus, the anchor body having a fluid flow channel therethrough, the anchor body below and spaced apart from a lower end of the concave, the concave having a fluid flow channel therethrough, and a flexible fluid flow member interconnecting and in fluid communication with the fluid flow channel of the concave and the fluid flow channel of the anchor body.

2. The whipstock system of claim 1 further comprising the grip apparatus having a grip slot and the anchor apparatus including an anchor body above the grip apparatus, and anchor body mating member for acting with and in the grip slot to guide movement of the grip apparatus with respect to the anchor apparatus.

3. The whipstock system of claim 1 further comprising the anchor apparatus including an anchor housing within which the grip apparatus is initially located, and grip releasable apparatus releasably holding the grip apparatus to the anchor housing.

4. The whipstock system of claim 1 wherein the grip apparatus is movable out from the anchor apparatus to set the whipstock system and is then movable back into the anchor apparatus to facilitate retrieval of the whipstock system from the earth wellbore.

5. The whipstock system of claim 1 wherein the grip apparatus is movable out from the anchor apparatus to push the anchor apparatus against a first part of the interior surface of the second tubular causing the concave to move against a second part of the interior surface of the second tubular spaced apart from the first part.

6. The whipstock system of claim 1 further comprising holding apparatus for holding the pushing apparatus up against the grip apparatus to maintain setting of the whipstock system.

7. The whipstock system of claim 6 wherein the holding apparatus is releasably secured to the pushing apparatus for selective release thereby allowing the pushing apparatus to move down and away from the grip apparatus so that the grip apparatus is movable back into the anchor apparatus to un-set the whipstock system.

8. The whipstock system of claim 6 wherein the holding apparatus includes a central mandrel connected to the anchor apparatus and running through a central channel through the pushing apparatus, the central mandrel having a portion with mandrel ratchet teeth, and the pushing apparatus having a portion with pushing apparatus ratchet teeth for ratchetingly acting with the mandrel ratchet teeth to prevent downward movement of the pushing apparatus while allowing upward movement thereof to push the grip apparatus out from the anchor apparatus.

9. The whipstock system of claim 8 wherein the portion of the pushing apparatus having the pushing apparatus ratchet teeth is a separate part releasably secured to the pushing apparatus for selective disengagement therefrom to free the pushing apparatus from the central mandrel permitting downward movement of the pushing apparatus and un-setting of the grip apparatus.

10. The whipstock system of claim 1 further comprising a central mandrel connected to the anchor apparatus and having a top end and a bottom end, the anchor apparatus including an anchor housing, within which is disposed an anchor body positioned above the grip apparatus, the slip apparatus initially disposed within the anchor housing above the pushing apparatus, the anchor housing having a sealed-off lower end, the pushing apparatus including a pusher sleeve below the grip apparatus and a piston below the pusher sleeve, the central mandrel extending down from the anchor body, through the grip apparatus, through the pushing apparatus, and through the piston, a fluid flow channel through the whipstock system including channels through the concave, through a member interconnecting the concave and the anchor body, and through the central mandrel, and fluid flowable under pressure from earth surface to the whipstock system, through the fluid flow channel, and out through at least one lower exit port at the bottom end of the central mandrel beneath the piston to force the piston and thereby the pusher sleeve upwardly to move the grip apparatus from the anchor housing to set the whipstock system within the second tubular.

11. The whipstock system of claim 1 wherein the first tubular comprises a string of tubing and the second tubular comprises a string of casing, both strings disposed in an earth wellbore and extending down into the wellbore from an earth surface.

12. The whipstock system claim 1 further comprising at least one auxiliary grip member on the anchor apparatus spaced radially apart from the slip apparatus.

13. The whipstock system of claim 1 wherein the string of tubing is coiled tubing.

14. The whipstock system of claim 1 wherein the grip apparatus is from the group consisting of slip apparatus and non-marking gripping apparatus.

15. The whipstock system of claim 1 further comprising a retrieval tool releasably connected to the whipstock system for removing the whipstock system from the earth wellbore, wherein the concave has a top lip slot and a concave surface and wherein the retrieval tool comprises a body, a hollow sleeve connected to and with a portion extending down beyond the body, the sleeve having an inner lip for receipt within the top lip slot of the concave, a movable member selectively releasably held within a body channel in the body, a spring in the body channel urging the movable member outwardly therefrom, holding apparatus releasably holding the movable member within the body channel, and the movable member movable out from the body channel upon release of the holding apparatus to contact the concave surface to stabilize the retrieval tool on the concave.

16. The whipstock system of claim 15 wherein the holding apparatus comprises a piston movably disposed with a piston channel of the body, the piston releasably connected to the movable member and positioned for contact by a top of the concave so that force on the piston releases the piston from the movable member thereby freeing the movable member for movement by the spring.

17. The whipstock system of claim 16 wherein the piston has a reduced diameter portion, a dog initially has part thereof disposed in a slot in the movable member, and part of the dog is initially disposed in a corresponding slot of the piston, releasably holding the movable member, movement of the piston by contact with the top of the concave moving the reduced diameter portion of the piston adjacent the dog permitting the dog to move away from the movable member thereby freeing the movable member for downward movement with respect to the concave.

18. A method for setting a whipstock system in a second tubular in an earth wellbore, the whipstock system comprising a concave, anchor apparatus connected to and below the concave, grip apparatus movably disposed within the anchor apparatus, pushing apparatus below the grip apparatus for pushing the grip apparatus upwardly and outwardly from the anchor apparatus for contacting the interior surface of the second tubular to set the whipstock system therein, and fluid flow apparatus for conducting fluid under pressure through the concave and through the anchor apparatus to push up on the pushing apparatus, wherein the whipstock system is retrieved with a retrieval tool comprising a body, a hollow sleeve connected to and with a portion extending down beyond the body, the sleeve having an inner lip for receipt within the top lip slot of the concave, a movable member selectively releasably held within a body channel in the body, a spring in the body channel urging the movable member outwardly therefrom, holding apparatus releasably holding the movable member within the body channel, and the movable member movable out from the body channel upon release of the holding apparatus to contact the concave surface to stabilize the retrieval tool on the concave, the method comprising introducing fluid under pressure through the fluid flow apparatus to move the pushing apparatus, and setting the grip apparatus by moving the pushing apparatus upwardly.

19. The method of claim 18 wherein the grip apparatus is movable out from the anchor apparatus to set the whipstock system and is then movable back into the anchor apparatus to facilitate retrieval of the whipstock system from the earth wellbore, the method further comprising moving the grip apparatus back into the anchor apparatus, and retrieving the whipstock system from the earth wellbore.

20. The method of claim 18 wherein the whipstock system includes holding apparatus for holding the pushing apparatus up against the grip apparatus to maintain setting of the whipstock system, the method further comprising selectively and releasably holding the pushing apparatus up against the grip apparatus.

21. The method of claim 18 wherein the slip apparatus is movable out from the anchor apparatus to push the anchor apparatus against a first part of the interior surface of the second tubular causing the concave to move against a second part of the interior surface of the second tubular spaced apart from the first part, the method further comprising moving the grip apparatus out from the anchor apparatus to push the anchor apparatus against a first part of the interior surface of the second tubular and thereby moving the concave against a second part of the interior surface of the second tubular spaced apart from the first part.

22. An anchor apparatus for anchoring a wellbore item in a tubular member or in a wellbore, the anchor apparatus comprising a concave, an anchor body connected to and below the concave, grip apparatus movably disposed within the anchor body, pushing apparatus below the grip apparatus for pushing the grip apparatus upwardly and outwardly from the anchor body for contacting the interior surface of the second tubular to set the anchor apparatus in the tubular member or in the wellbore, and fluid flow apparatus for conducting fluid under pressure through the concave and through the anchor body to push up on the pushing apparatus.

23. The anchor apparatus of claim 22 further comprising an anchor housing within which the grip apparatus is initially located, and a grip releasable apparatus releasably holding the grip apparatus to the anchor housing, the grip apparatus is movable out from the anchor body and is then movable back into the anchor body, the grip apparatus movable out from the anchor body to push the anchor body against a first part of the interior surface of the second tubular causing the concave to move against a second part of the interior surface of the second tubular spaced apart from the first part, and holding apparatus for holding the pushing apparatus up against the grip apparatus.

24. The anchor apparatus of claim 22 further comprising the grip apparatus comprising slip apparatus.

* * * * *